US010527262B2

(12) United States Patent
SanFacon et al.

(10) Patent No.: US 10,527,262 B2
(45) Date of Patent: Jan. 7, 2020

(54) CONCEALED CONNECTION SYSTEM FOR LUMINAIRES

(71) Applicant: Focal Point, LLC, Chicago, IL (US)

(72) Inventors: Michael David SanFacon, Naperville, IL (US); Krutin S. Desai, Chicago, IL (US)

(73) Assignee: Focal Point, LLC, Chicago, IL (US)

( * ) Notice: Subject to any disclaimer, the term of this patent is extended or adjusted under 35 U.S.C. 154(b) by 136 days.

(21) Appl. No.: 15/902,679

(22) Filed: Feb. 22, 2018

(65) Prior Publication Data

US 2018/0180265 A1 Jun. 28, 2018

Related U.S. Application Data

(63) Continuation-in-part of application No. 14/876,622, filed on Oct. 6, 2015, now Pat. No. 9,995,466.

(51) Int. Cl.

| | |
|---|---|
| ***F21V 21/005*** | (2006.01) |
| ***F21V 21/04*** | (2006.01) |
| ***F21S 2/00*** | (2016.01) |
| ***F21V 17/10*** | (2006.01) |

(52) U.S. Cl.

CPC ..... *F21V 21/005* (2013.01); *F21S 2/005* (2013.01); *F21V 17/10* (2013.01); *F21V 21/04* (2013.01)

(58) Field of Classification Search

CPC .... F21V 21/005; F21V 17/005; F21V 15/015; F21V 17/10; F21S 2/005

See application file for complete search history.

(56) References Cited

U.S. PATENT DOCUMENTS

| | | | | |
|---|---|---|---|---|
| 2012/0063138 | A1* | 3/2012 | Leadford | F21S 2/005 362/249.02 |
| 2014/0049954 | A1* | 2/2014 | Ladstaetter | F21S 4/20 362/221 |
| 2014/0268718 | A1* | 9/2014 | Yu | F21V 19/008 362/217.14 |
| 2015/0070882 | A1 | 3/2015 | Ohno | |

* cited by examiner

*Primary Examiner* — Karabi Guharay
(74) *Attorney, Agent, or Firm* — Banner & Witcoff, Ltd.

(57) ABSTRACT

A connection system accommodates small aperture fixtures and provides ample room for electrical connections and a cosmetically superior seam. The connection system may consist of two mating brackets for the concealed joining of segments of light fixtures. The joiner design is completely integral to a fixture, with no externally visible hardware and no additional visual seams. Due to the sweeping nature of the joining action, internal fixture components do not need to be removed in order for correct joining to occur. Additionally this design requires that no components are removed from the fixture prior to joining, significantly reducing the time and effort that goes into joining fixtures in runs.

20 Claims, 24 Drawing Sheets

CONCEALED CONNECTION SYSTEM FOR LUMINAIRES

This application is a continuation-in-part of U.S. application Ser. No. 14/876,622; filed Oct. 6, 2015, now U.S. Pat. No. 9,995,466 which is incorporated herein by reference in its entirety.

BACKGROUND

Luminaires may come in a variety of sizes and shapes. Some luminaires may consist of a series of individual lighting fixtures connected together, allowing the fixtures to be manufactured in sections and then later assembled into a larger array or pattern of light fixtures. The housings of these light fixtures are typically connected together to create luminaires of different lengths and shapes. However, the assembly of the light fixtures to form an array or pattern can be difficult and time consuming, especially if several luminaires need to be joined together. A joining system and method that can easily align and connect the individual light fixtures together can decrease the time required to install the light fixtures. Additionally, a joint connection system is desired that will provide an aesthetically-pleasing look that provides a seamless connection with no visible fasteners. A joint connection system is also desired that provides a consistent, straight, and uniform alignment of the joined fixtures at the fixture joints, providing no gaps or visible joint seams.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting light fixtures to form a simple joint comprising an inner joining member and an outer joining member that slide together. A connection system for a luminaire may comprise an inner mating bracket and an outer mating bracket. The outer mating bracket may be configured to attach to a first light fixture. The outer mating bracket may comprise a base, a first side wall, a second side wall, and a rear wall. The first side wall and the second side wall may extend from the base and may be connected with the rear wall opposite the base. Each side wall of the outer mating bracket may include a curved scoop ledge that extends from the rear wall along an inner portion of the first side wall and an inner portion of the second side wall. The base of the outer mating bracket may include one or more holes to provide access to install one or more securing members into a securing structure on an internal portion of the first light fixture. The outer mating bracket may include one or more locating posts to align the outer mating bracket and inhibit rotation of the outer mating bracket with respect to the first light fixture. The inner mating bracket may be configured to attach to a second light fixture. The inner mating bracket may comprise a base, a first side wall, and a second side wall opposite the first wall. The first side wall and the second side wall may extend from the base, with each side wall having a curved ramp edge and a stopping edge. The base of the inner mating bracket may include one or more holes to provide access to install one or more securing members into a securing structure on an internal portion of the second light fixture. The inner mating bracket may include one or more locating posts to align the inner mating bracket and inhibit rotation of the inner mating bracket with respect to the second light fixture. Further, gravity assisted, the inner mating bracket may slide and nest within the outer mating bracket with the curved ramp edge of the inner mating bracket coupling with the curved scoop ledge on the outer mating bracket, thereby connecting the first light fixture to the second light fixture and creating a concealed and seamless connection between the inner mating bracket of the first light fixture and the outer mating bracket of the second light fixture.

Another aspect of this invention relates to a luminaire that comprises a first light fixture with an outer mating bracket attached to the first light fixture, a second light fixture with an inner mating bracket attached to the second light fixture, and a center joining plate that slides between the first light fixture and the second light fixture to secure the first and second light fixtures together. The outer mating bracket may comprise a base, a first side wall, a second side wall, and a rear wall. The first side wall and the second side wall extend from the base and are connected with the rear wall opposite the base. Each side wall of the outer mating bracket may include a curved scoop ledge that extends from the rear wall along an inner portion of the first side wall and an inner portion of the second side wall. The outer mating bracket may be secured to the first light fixture with one or more securing members through the base of the outer mating bracket to an internal portion of the first light fixture. The outer mating bracket may include one or more locating posts to align the outer mating bracket and inhibit rotation of the outer mating bracket with respect to the first light fixture. The inner mating bracket may comprise a base, a first side wall, and a second side wall opposite the first wall, wherein the first side wall and the second side wall extend from the base. Each side wall may have a curved ramp edge and a stopping edge. The inner mating bracket may be secured to the second light fixture with one or more securing members through the base of the inner mating bracket to an internal portion of the second light fixture. The inner mating bracket may include one or more locating posts to align the inner mating bracket and inhibit rotation of the inner mating bracket with respect to the second light fixture. Further, gravity assisted, the inner mating bracket may slide and nest within the outer mating bracket with the curved ramp edge of the inner mating bracket coupling with the curved scoop ledge on the outer mating bracket thereby connecting the first light fixture to the second light fixture and creating a concealed and seamless connection between the first light fixture and the second light fixture.

BRIEF DESCRIPTION OF THE DRAWINGS

The present invention is illustrated by way of example and not limited in the accompanying figures in which like reference numerals indicate similar elements and in which.

Figure 1:
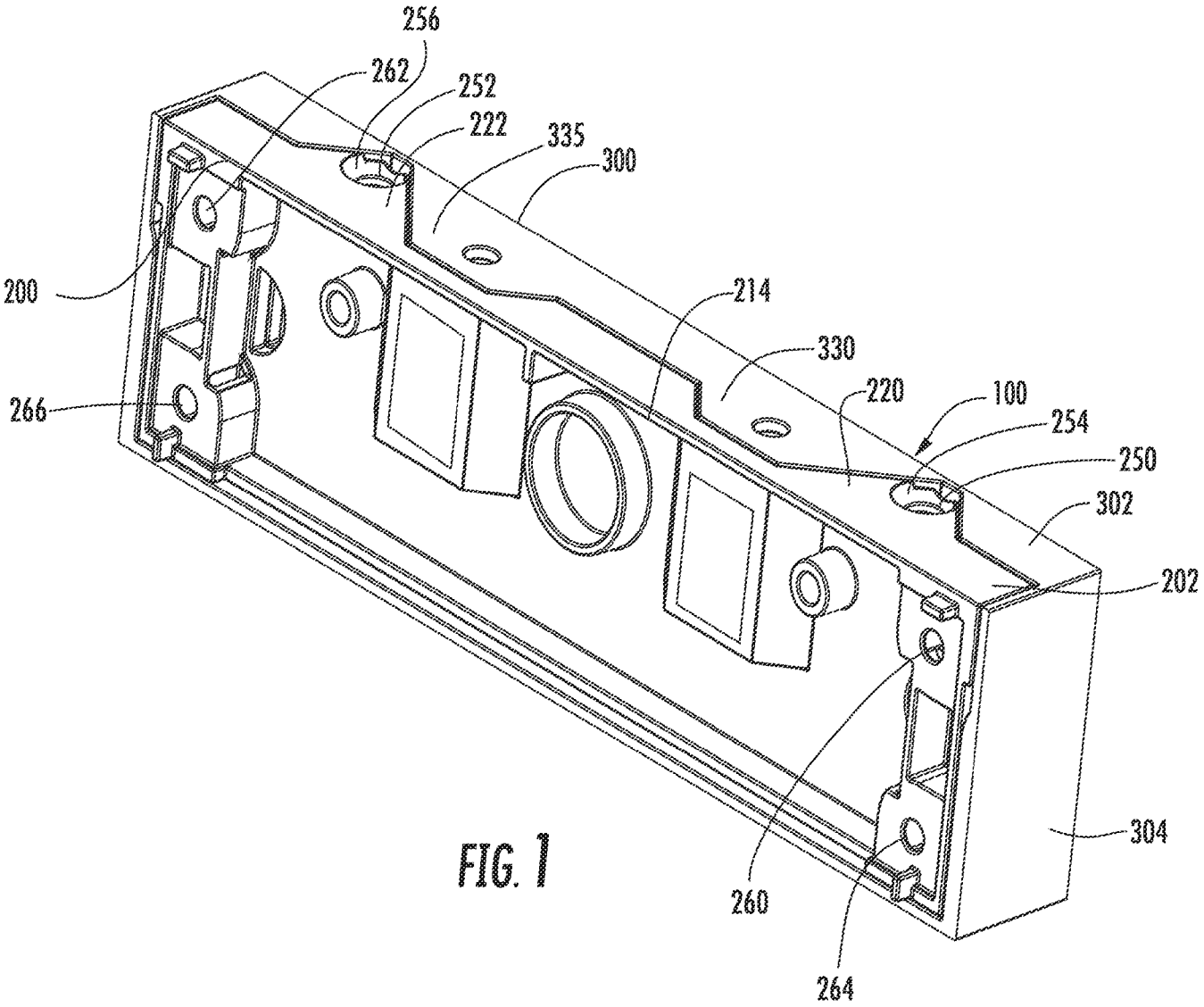
FIG. 1 illustrates an top front perspective view of an example embodiment of a connection system according to one or more aspects described herein.
Figure 2:
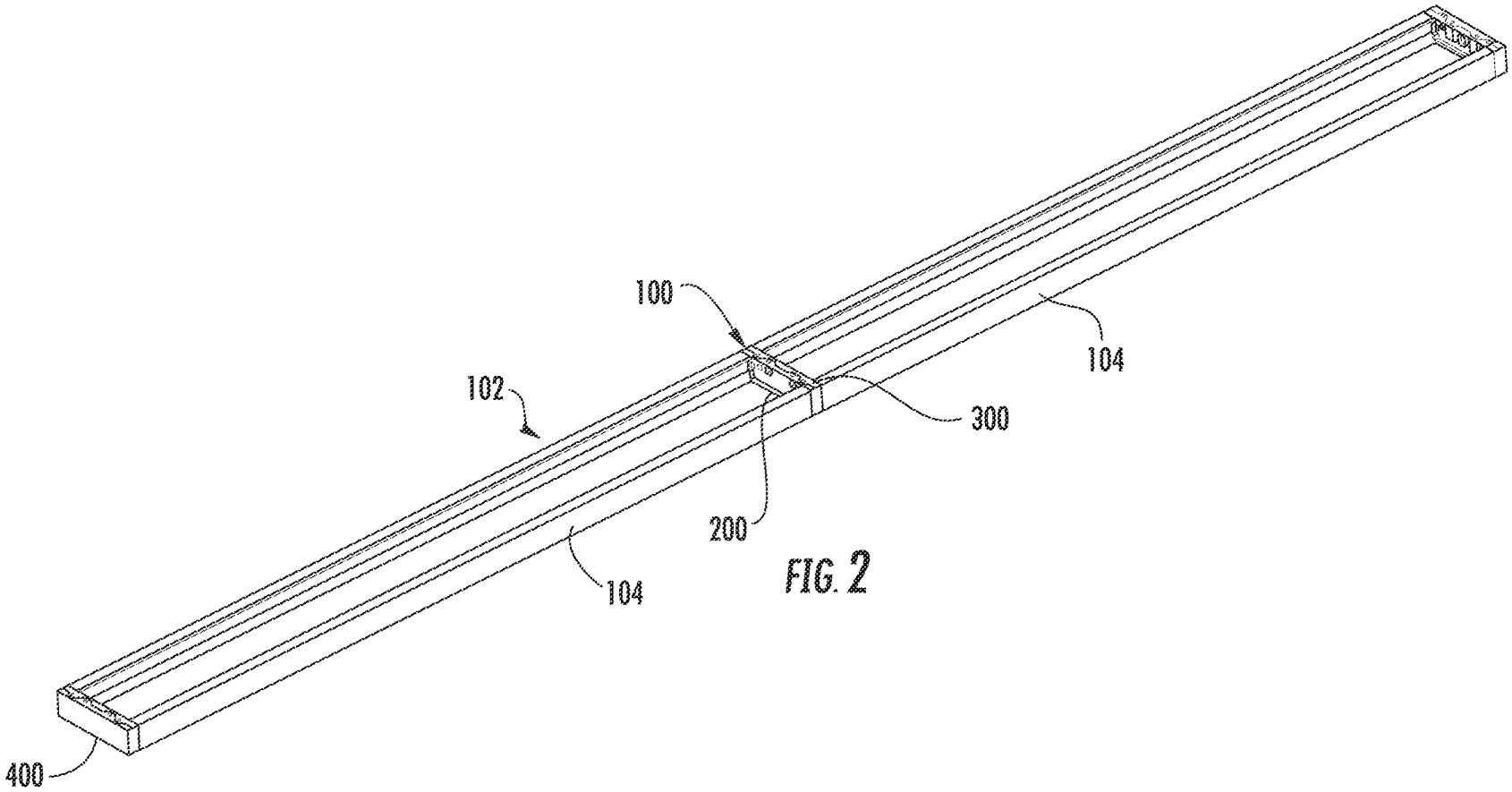
FIG. 2 illustrates a top front perspective view of an example embodiment of a lighting fixture assembly using an embodiment of the connection system according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Generally parallel" or "parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Generally perpendicular" or "perpendicular" means that a first line, segment, plane, edge, surface, etc. is approximately (in this instance, within 5%) oriented approximately 90 degrees from another line, plane, edge, surface, etc., over at least 50% of the length of the first line, segment, plane, edge, surface, etc.

"Plurality" indicates any number greater than one, either disjunctively or conjunctively, as necessary, up to an infinite number.

In the following description of the various embodiments, reference is made to the accompanying drawings, which form a part hereof, and in which is shown, by way of illustration, various embodiments in which aspects of the disclosure may be practiced. It is to be understood that other embodiments may be utilized and structural and functional modifications may be made without departing from the scope and spirit of the present disclosure.

In general, as described above, aspects of this invention relate to a system and method for connecting the housings of light fixtures to enable easy installation of the light fixtures using multiple runs. More detailed descriptions of aspects of this invention follow.

One aspect of this invention relates to a connection system for joining various light fixtures together. Such systems may include, for example (a) an inner joining member 200 having a top surface 202, a first side surface 204, a bottom surface 206, a second side surface 208, where each side surface 204, 208 has a recessed surface 210, 212 and a guide surface 280, 282; and (b) an outer joining member 300 having a top surface 302, a first exterior side surface 304 having an interior surface 316, a bottom surface 306, a second exterior side surface 308 having an interior surface 318 where each interior side surface 316, 318 has a recessed surface 310, 312 and a guide surface 380, 382.

FIG. 1 shows a perspective view of an example embodiment of the connection system 100. The inner joining member 200 is nested within the outer joining member 300 such that the inner joining member is not visible except from the top when the lighting fixtures are connected together. The connection system 100 may be primarily used for joining light fixtures. The example embodiment of the connection system 100 shown in FIG. 1 creates a joint to connect multiple light fixtures 102 as shown in FIGS. 2, 3, 3A, and 3B.

Figure 3:
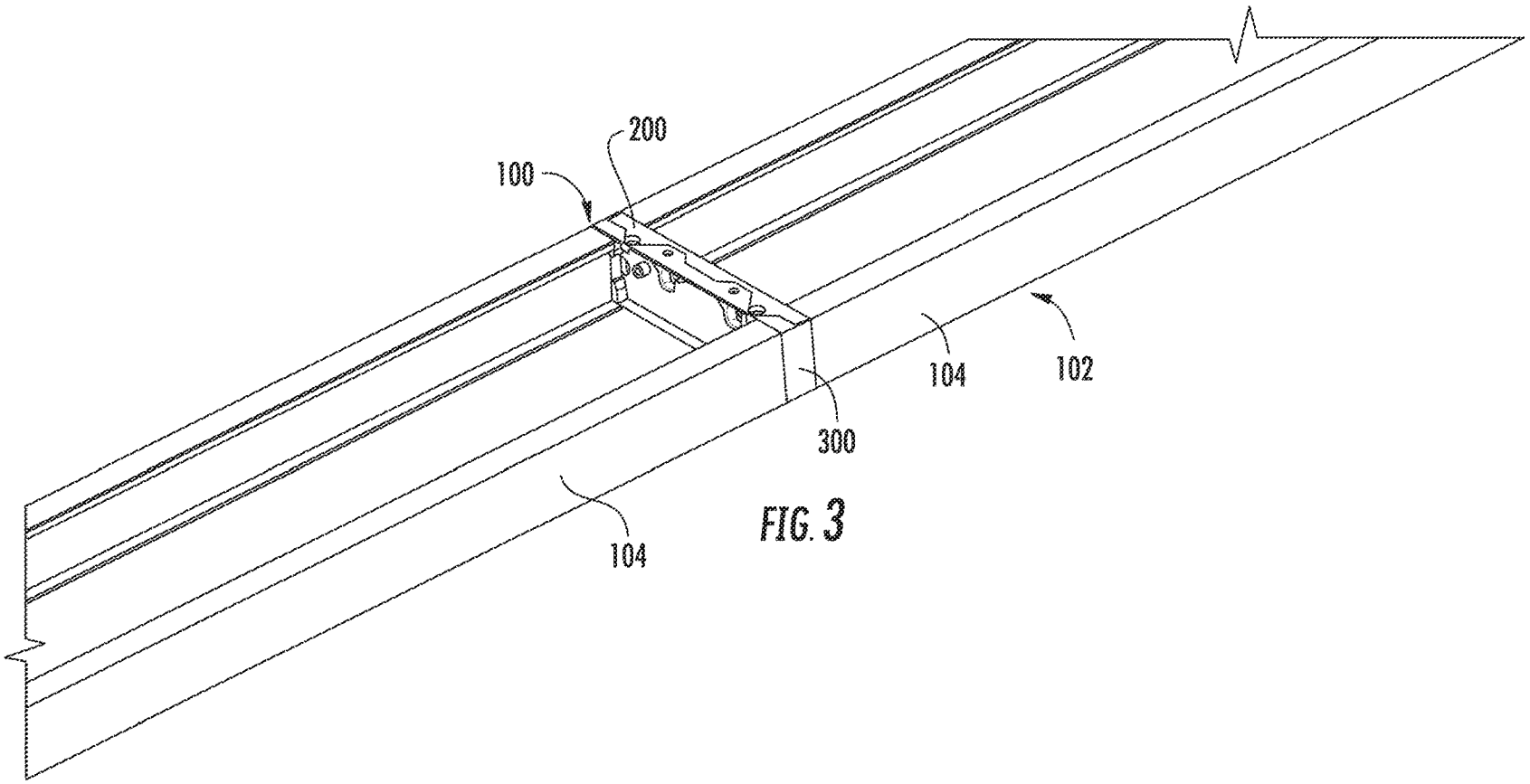
FIG. 3 illustrates a magnified view of the top front perspective view of FIG. 2.
Figure 3A:
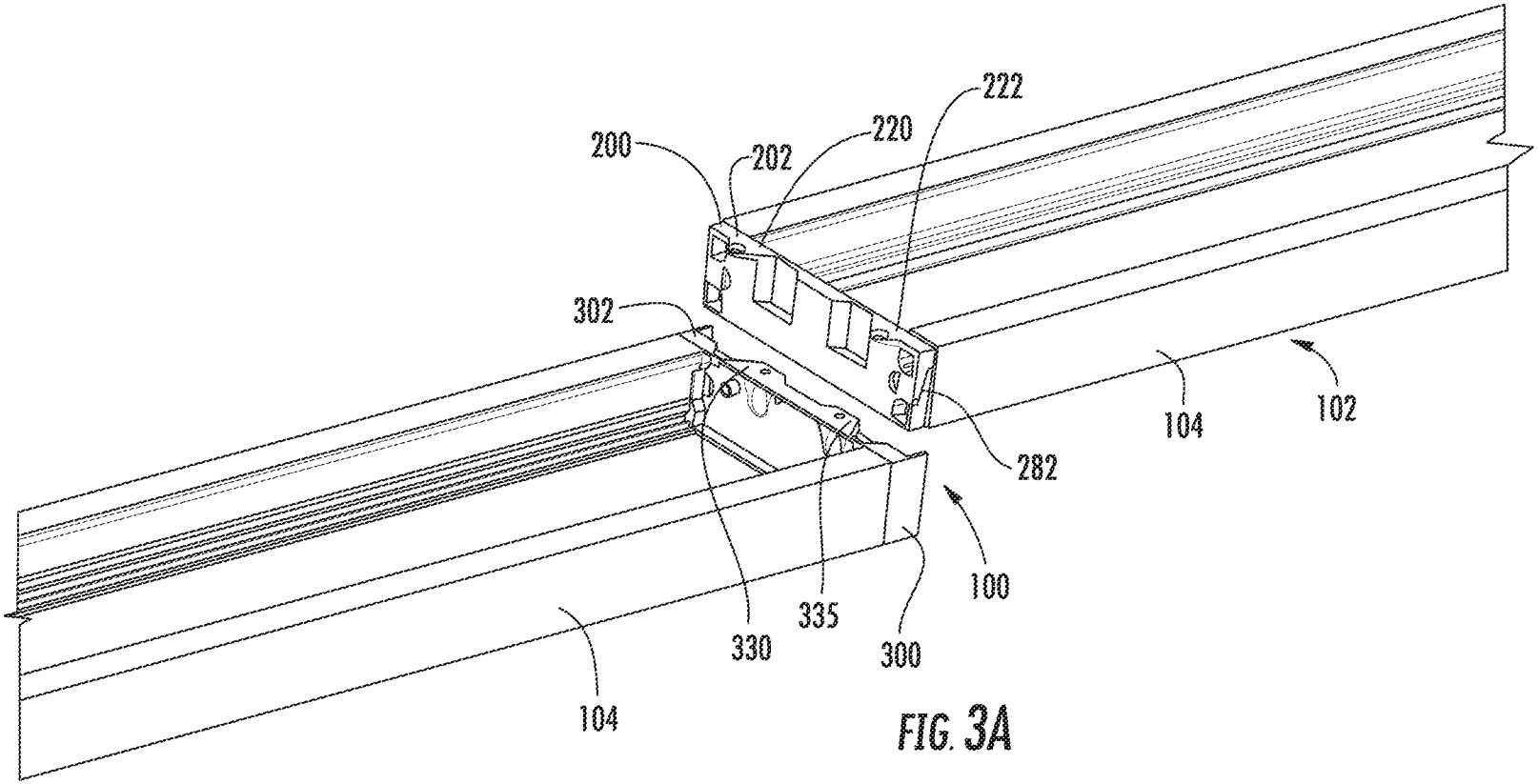
FIGS. 3A and 3B illustrate a top front perspective view of a partially assembled connection system of the example embodiment of FIG. 2
Figure 3B:
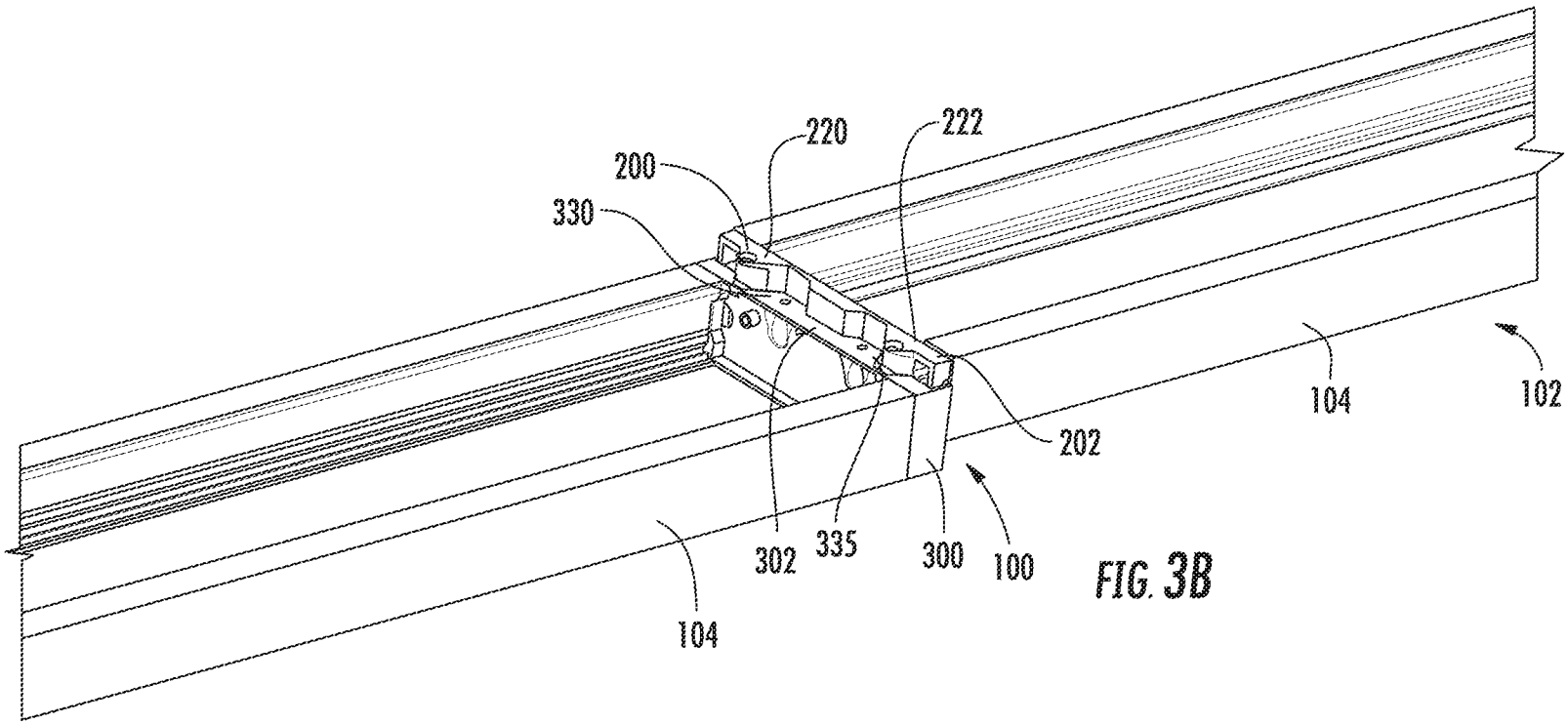

The inner joining member 200 and the outer joining member 300 may be slidably engaged as shown in FIGS. 3, 3A and 3B. The inner joining member 200 may be assembled to an end of a housing(s) 104 of a first light fixture 102. The outer joining member may be assembled to an end of a housing(s) 104 of a second light fixture 102. The outer joining member 300 may be connected by sliding the inner joining member 200 into the outer joining member 300 in a vertical direction where the guide surfaces 280, 282 are in communication with the guide surfaces 382, 380 respectively of the outer joining member 300, thereby joining the housing of the first light fixture 102 and the housing of the second light fixture 102.

As previously mentioned, both the inner joining member 200 and outer joining member 300 may have a plurality of guide surfaces to properly align the structures and inhibit rotation of the inner joining member 200 with respect to the outer joining member 300. Additionally, the guide surfaces of the inner joining member 200 and the outer joining member 300 pull together the joining members 200 300 and thus the housings 104 that each joining member 200, 300 is attached to, which further minimizes any gaps between the housing 104 and the joining members 200, 300 with the outer joining member 300 being drawn to the housing 104. For example, each side surface 204, 206 of the inner joining member 200 may have a guide surface 280, 282 in communication with guide surfaces 380, 382 of the outer joining member 300. More specifically, guide surface 280 of inner joining member 200 may confront guide surface 382 of outer joining member 300, and guide surface 282 of inner joining member 200 may confront guide surface 380 of outer joining member 300.

The outer joining member 300 may have a plurality of recesses 320, 322 positioned within the top surface 302 that receive at least a portion of a plurality of flanges 220, 222 of the inner surface 200. Also, the inner joining member 200 may have plurality of recesses 230, 235 in the top surface 202 that receive at least a portion of the plurality of flanges 330, 335 on the top surface 302. The plurality of flanges and recesses on both the inner joining member and the outer joining member may ensure the proper alignment and prevent rotation of the inner joining member 200 with respect to the outer joining member 300. The inner joining member 200 may be secured to the outer joining member 300 via plurality of securing members (not shown) such as a mechanical fastener installed through a plurality of holes 250, 252 of inner joining member 200 into a plurality of securing structures 350, 352 of outer joining member 300. The inner joining member 200 may securely engage the outer joining member 300 in only one orientation.

Inner Joining Member

Figure 6:
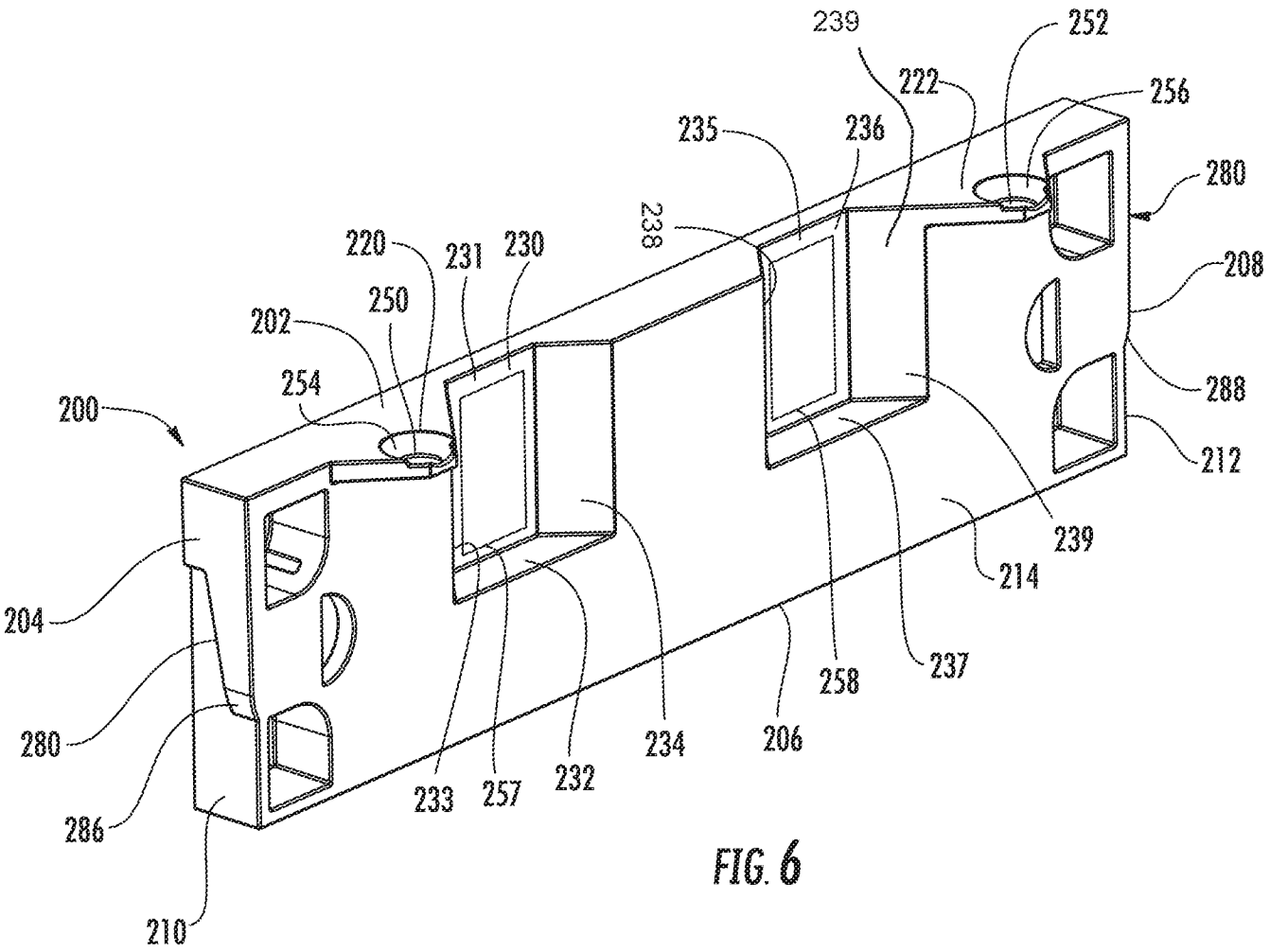
FIG. 6 illustrates a top front perspective view of a component of the connection system of FIG. 1.
Figure 7:
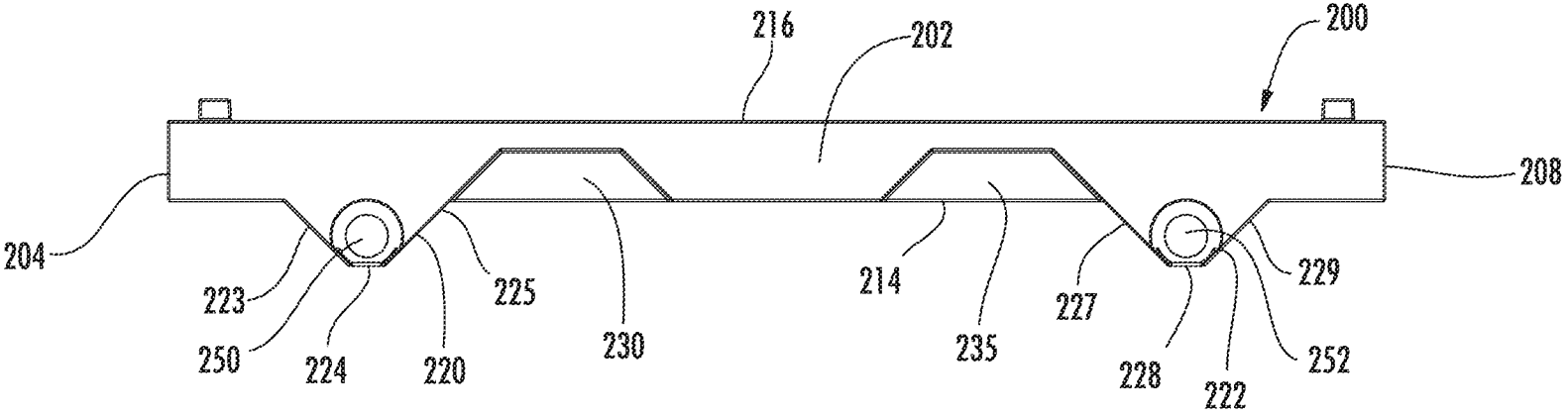
FIG. 7 illustrates a top view of the component of FIG. 6.
Figure 8:
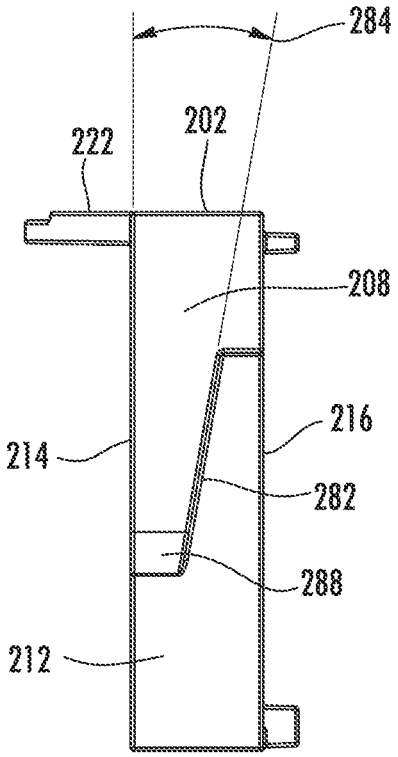
FIG. 8 illustrates a side view of the component of FIG. 6.

The inner joining member 200 shown individually in FIGS. 6-8 may comprise a top surface 202, a first side surface 204, a second side surface 208, and a bottom surface 206, where each side surface 204, 208 has a recessed surface 210, 212 and a guide surface 280, 282. Additionally, the top surface 202 may comprise a plurality of flanges 220, 222 and a plurality of recesses 230, 235. The guide surface 280 may connect between the side surface 204 and the recessed surface 210. Likewise, guide surface 282 may connect between the side surface 208 and the recessed surface 212. In addition, a ramp surface 286 may be adjacent to the guide surface 280 and taper from the side surface 204 and the recess surface 210. Similarly, a ramp surface 288 may be adjacent to the guide surface 282 and taper from the side surface 208 and the recess surface 212. The ramp surfaces 286, 288 may assist in further aligning and orienting the inner joining member 200 and outer joining member 300 as they engage each other.

As shown in FIG. 8, the guide surfaces 280, 282 may be positioned at an angle 284 defined from the front surface 214 to the guide surface, such that the guide surfaces 280, 282 may create a taper or wedge to align the inner joining member 200 to the outer joining member 300 and inhibit rotation of the inner joining member 200 with respect to the outer joining member 300 as the joining members are assembled. The guide surfaces 280, 282 may be positioned at the same angle, or alternatively, the guide surfaces may be positioned at different angles. The angle 284 may be within a range of 1 degree to 45 degrees. A variety of guide surfaces or other rotation inhibiting structures and systems may be used without departing from this invention including guide members that are asymmetrical such as having a differently shaped rotation inhibiting structure on the first side wall 204 than on the second side wall 208.

Each guide surface 280, 282 may have a sufficient width to provide an adequate non-rotational engagement. The width may be defined as the distance to from their respective side surfaces 204, 208 to their respective recessed surfaces 210, 212.

The inner joining member 200 may have a plurality of flanges 220, 222 on the top surface 202. Each flange 220, 222 may have a first angled surface 223, 227, a forward surface 224, 228, and a second angled surface 225, 229. The first flange 220 may have a first angled surface 223, a forward surface 224, and a second angled surface 225, where the forward surface 224 connects the first angled surface 223 and the second angled surface 225. Similarly, the second flange 222 may have a first angled surface 227, a forward surface 228, and a second angled surface 229, where the forward surface 228 connects the first angled surface 227 and the second angled surface 229.

Additionally, the flanges 220, 222 may have openings 250, 252 respectively to provide an access to install a securing member (not shown) into a securing structure on the outer joining member 300. The openings 250, 252 may be holes having a countersink or counterbore region 254, 256 respectively to keep the head of the fastener to lie flush or substantially flush with the top surface 202. The countersink, or counterbore region 254, 256 may be asymmetrical to further assist in aligning the joining members 200, 300 and pulling the joining members 200, 300 together to minimize any gaps between the housing 104 and the joining members 200, 300.

As described previously, the inner joining member 200 may also have a plurality of recesses 230, 235 in the top surface 202. The plurality of recesses 230, 235 may be positioned between the flanges 220, 222 such that the flanges are closer to the side surfaces 204, 208. Alternatively, the plurality of recesses 230, 235 may be positioned closer to the side surfaces 204, 208 than the flanges 220, 222. As another embodiment, each flange 220, 222 may have one flange closer to a side surface and one recess closer to the other side surface.

The first recess may be adjacent to the first flange 220 such that the second angled surface 225 may be coplanar with the first side surface 233. Additionally, the second recess 235 may be adjacent to the second flange 222 such that the first angled surface 227 may be coplanar with the second side surface 239. Alternatively, only one of the recesses may be adjacent to one of the flanges or neither of the recesses may be adjacent to one of the flanges.

The first recess 230 may comprise a first surface 231 offset the front wall 214, a bottom surface 232 offset from the top surface 202, and a first side wall 233 and a second side wall 234. Similarly, the second recess 235 may comprise a first surface 236 offset the front wall 214, a bottom surface 237 offset from the top surface 202, and a first side wall 238 and a second side wall 239. The first recess 230 and the second recess 235 may have the same shape. For instance, the first surfaces 231, 236 of each recess 230, 235 and may be coplanar, and the bottom surfaces 232, 237 may be also be coplanar.

The first surface 231 of the first recess 230 and the first surface 236 of the second recess 235 may each have an opening 257, 258 respectively. The openings 256, 258 may enable cabling to pass through. The openings 256, 258 may be of any shape or size. For example, the openings may have a round, oval, generally rectangular with rounded corners.

Figure 4:
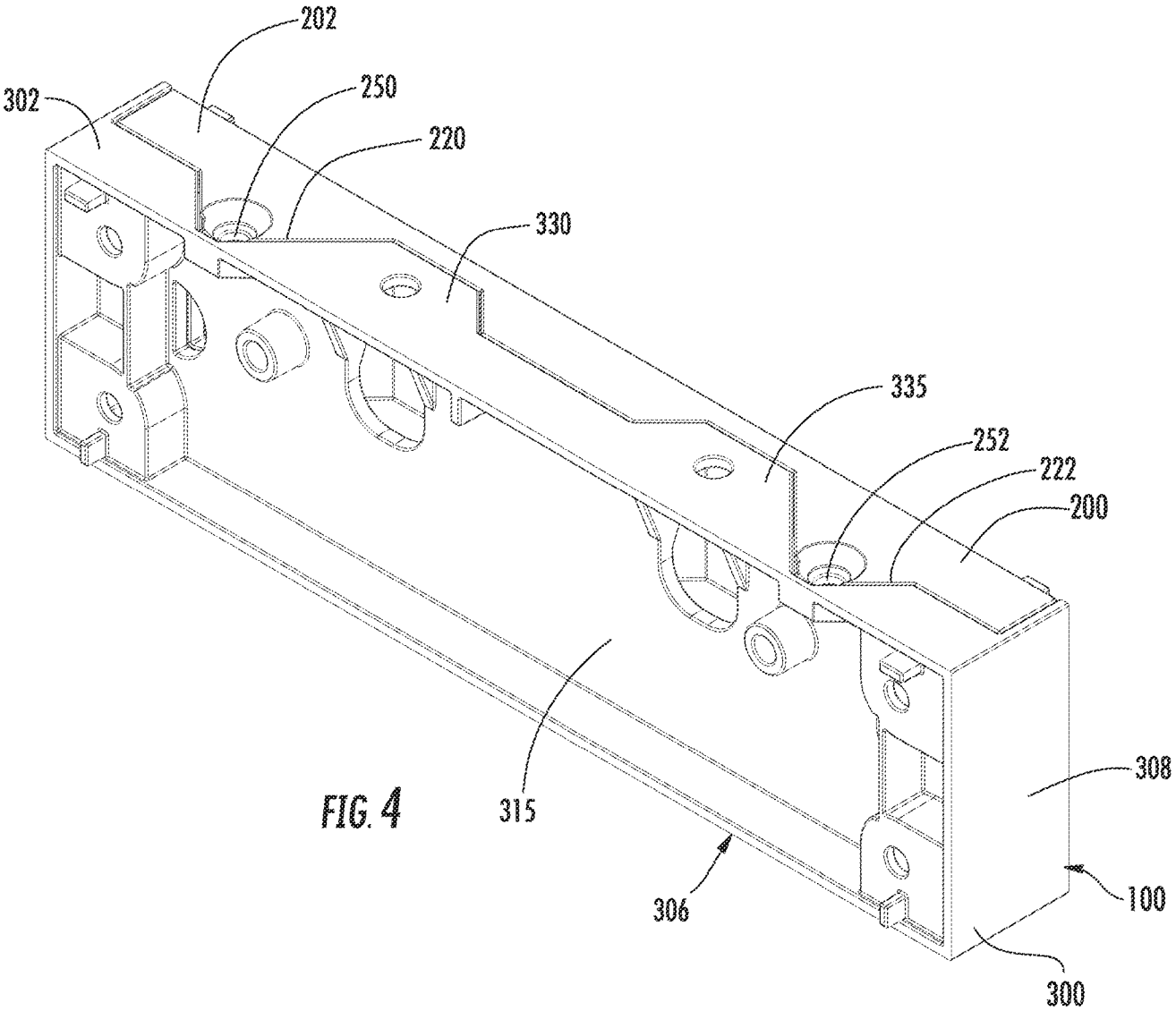
FIG. 4 illustrates a top rear perspective view of an example embodiment of a connection system of FIG. 1 according to one or more aspects described herein.
Figure 5:
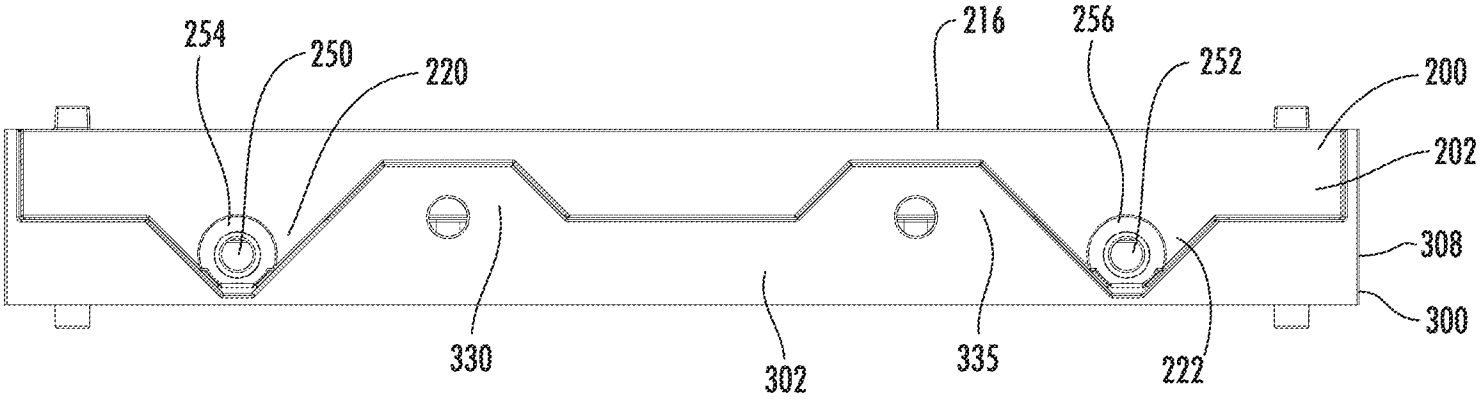
FIG. 5 illustrates a top view of the example embodiment of the connection system of FIG. 1.

As shown in FIGS. 1 and 7, the inner joining member 200 may have a plurality of engaging members positioned on at least a portion of the rear surface 216 and extending away from the surface 216. The plurality of engaging members are utilized for keyed and location alignment to ensure proper alignment and orientation of the inner joining member 200 and the housing(s) 104. These engaging members may engage features on the housing 104 to inhibit rotation as shown in FIG. 4.

Additionally, the inner joining member 200 may also have a plurality of holes 260, 262, 264, 266 extending through the inner joining member 200. Securing members (not shown) may be inserted through the plurality of holes 260, 262, 264, 266 and into corresponding securing structures (not shown) in the housing 104 of the light fixtures 102.

Outer Joining Member

Figure 9:
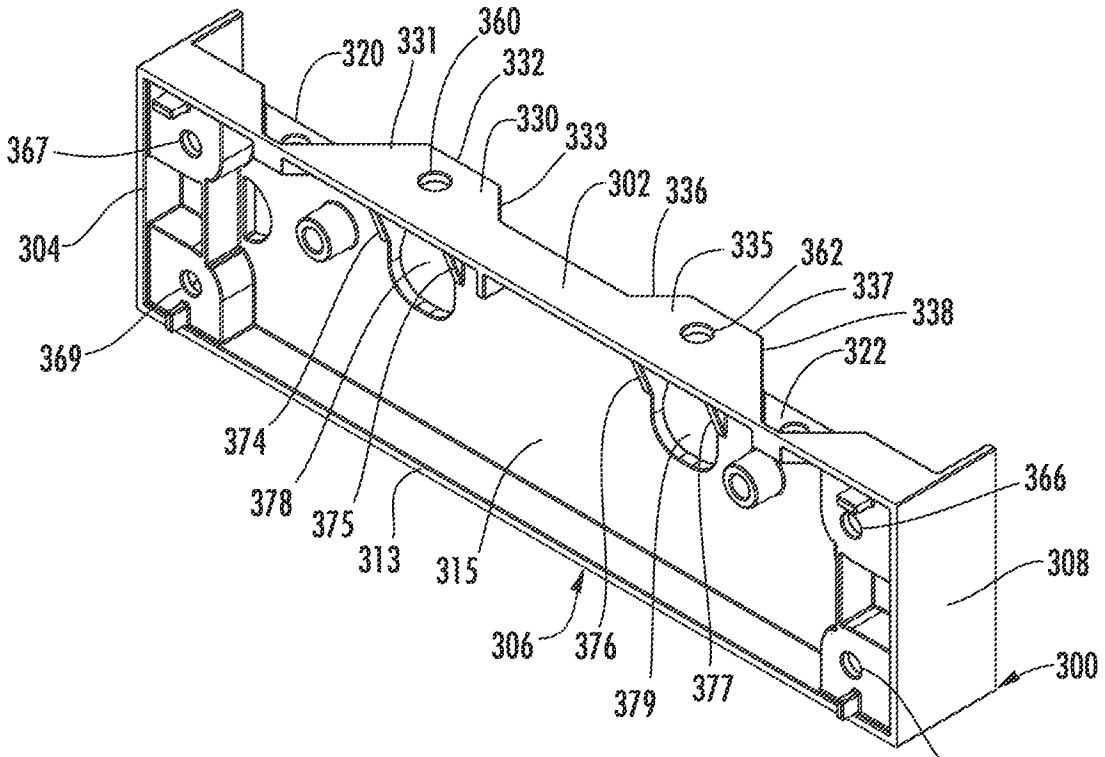
FIG. 9 illustrates a top front perspective view of a component of the connection system of FIG. 1.
Figure 10:
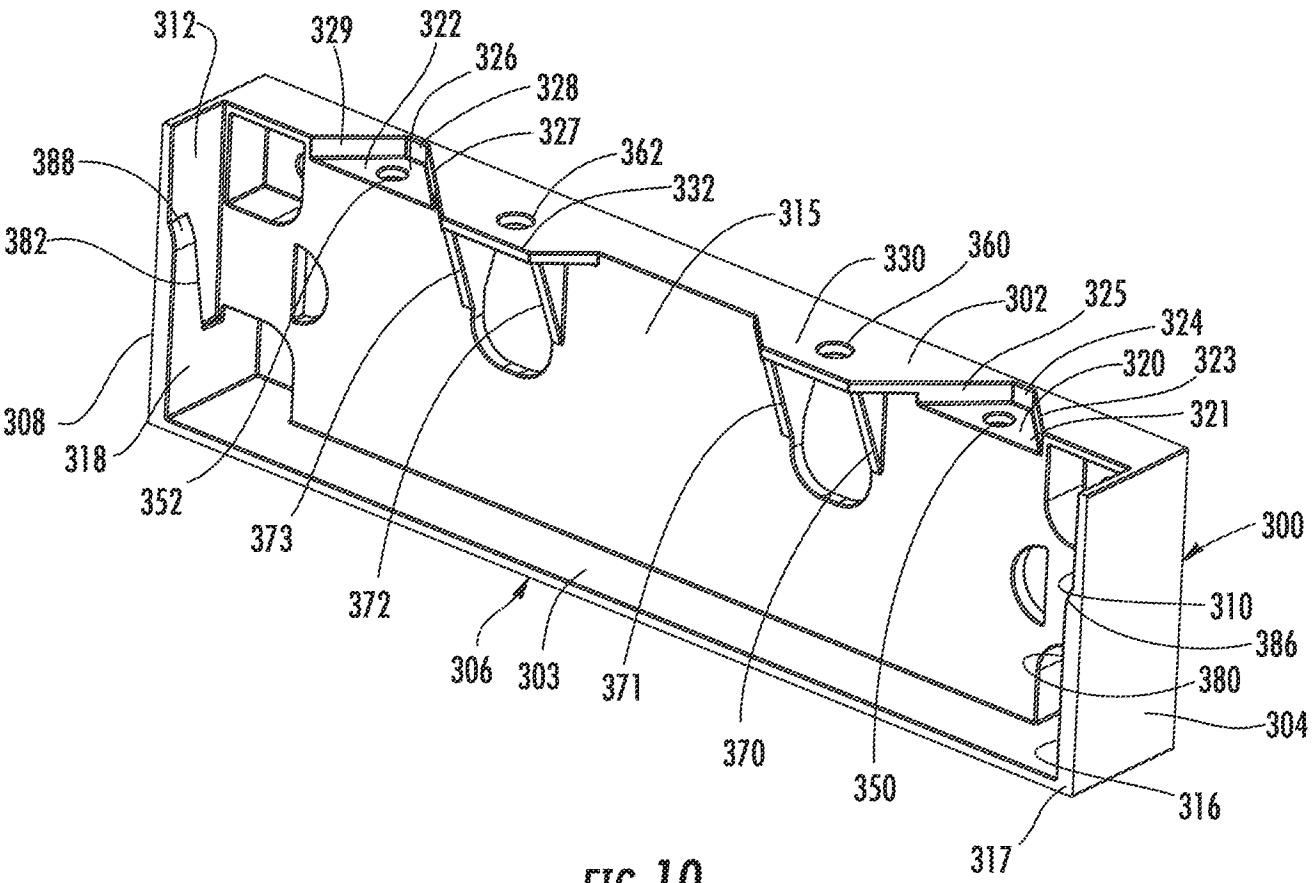
FIG. 10 illustrates a top rear perspective view of the component of FIG. 9.
Figure 11:
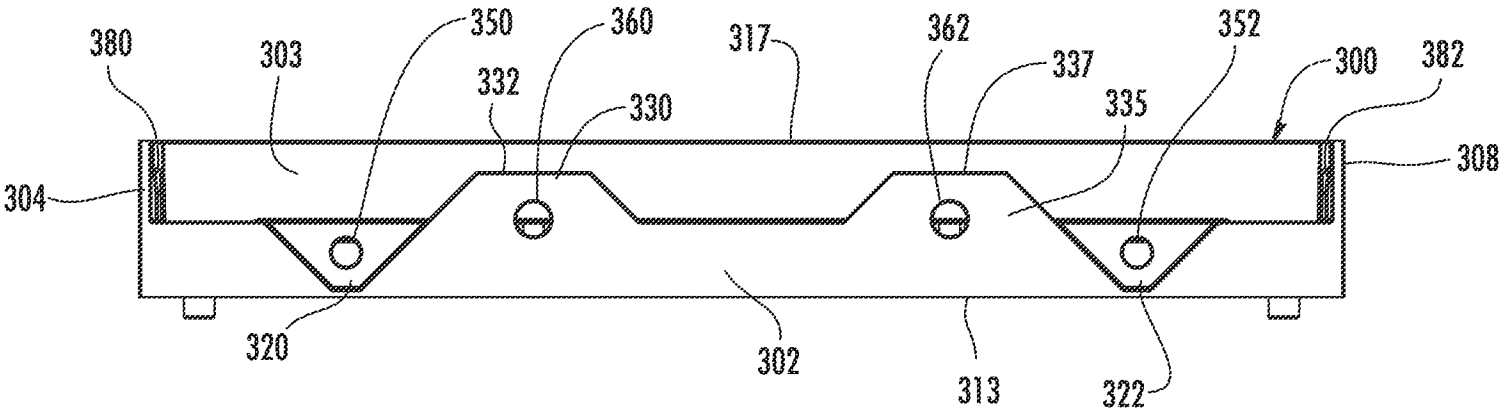
FIG. 11 illustrates a top view of the component of FIG. 9.

The outer joining member 300 shown individually in FIGS. 9-11 may comprise a top surface 302, a front surface 313, a central wall 315, a rear surface 317, a first side surface 304, a second side surface 308, a bottom surface 306, and a base surface 303 opposite the bottom surface 306, where each side surface 304, 308 has an interior surface 316, 318 with a recessed surface 310, 312 and a guide surface 380, 382. Additionally, the top surface 302 may comprise a plurality of flanges 330, 335 and a plurality of recesses 320, 322. The guide surface 380 may connect between the side surface 304 and the recessed surface 310. Likewise, guide surface 382 may connect between the side surface 308 and the recessed surface 312. In addition, a ramp surface 386 may be adjacent to the guide surface 380 and taper from the side surface 304 and the recess surface 310. Similarly, a ramp surface 388 may be adjacent to the guide surface 382 and taper from the side surface 308 and the recess surface 312. The ramp surfaces 386, 388 may assist in further aligning and orienting the inner joining member 200 and outer joining member 300 as they engage each other.

Similar to the guide surfaces 280, 282 on the inner joining member 200, the guide surfaces 380, 382 may be positioned at an angle defined from the front surface 313 to the guide surface, such that the guide surfaces 380, 382 may create a taper or wedge to align the inner joining member 200 to the outer joining member 300 and inhibit rotation of the inner joining member 200 with respect to the outer joining member 300 as the structures are assembled. The guide surfaces 380, 382 may be positioned at the same angle, or alternatively, the guide surfaces may be positioned at different angles. The angle may be within a range of 1 degree to 45 degrees. A variety of guide surfaces or other rotation inhibiting structures and systems may be used without departing from this invention including rotation inhibiting structures that are asymmetrical having a differently shaped guide surface on the first side wall 304 than on the second side wall 308.

Each guide surface 380, 382 may have a width defined as the distance to from their respective interior side surfaces 316, 318 to their respective recessed surfaces 310, 312. Additionally, the guide surfaces of the inner joining member 200 and the outer joining member 300 pull together the joining members 200 300 and thus the housing(s) 104 that each joining member 200, 300 is attached to, which further minimizes any gaps between the housing(s) 104 and the joining members 200, 300 with the outer joining member 300 being drawn to the housing(s) 104.

The outer joining member 300 may have a plurality of flanges 330, 335 on the top surface 302. Each flange 330, 335 may have a first surface 331, 336, a forward surface 332, 337, and a second surface 333, 338. The first flange 330 may have a first surface 331, a forward surface 332, and a second surface 333, where the forward surface 332 connects the first surface 331 and the second surface 333. Similarly, the second flange 335 may have a first surface 336, a forward surface 337, and a second surface 338, where the forward surface 337 connects the first surface 336 and the second surface 338. Lastly, the flanges 330, 335 may have openings 360, 362 respectively.

As shown in FIGS. 9 and 10, each flange 330, 335 may be supported by a plurality of gussets 370, 371, 372, 373, 374, 375, 376, 377 connected from a central wall 315 to the underside of the flanges. The gussets may be positioned on both sides of the central wall 315. Additionally, a plurality of openings 378, 379 may be located through the central wall 315 proximate the plurality of gussets 370, 371, 372, 373.

As described previously, the outer joining member 300 may also have a plurality of recesses 320, 322 in the top surface 302. The plurality of recesses 320, 322 may be positioned outside the flanges 330, 335 such that the recesses 320, 322 are proximate the side surfaces 304, 308. Alternatively, the plurality of recesses 320, 322 may be positioned between the flanges 330, 335 where flanges 330, 335 are closer to the side surfaces 304, 308 than the recesses 320, 322. As another embodiment, each recess 320, 322 may have one flange closer to a side surface and one recess closer to the other side surface.

The first recess 320 may be adjacent to the first flange 330 such that its first side surface 331 may be coplanar with the second side surface 325 of the first recess 320. Additionally, the second recess 322 may be adjacent to the second flange 335 such that its second side surface 338 may be coplanar with the first side surface 327 of the recess 322. Alternatively, only one of the recesses may be adjacent to one of the flanges or neither of the recesses may be adjacent to one of the flanges.

The first recess 320 may comprise a first surface 324 offset the rear wall 316, a bottom surface 321 offset from the top surface 202, and a first side surface 323 and a second side wall 325. Similarly, the second recess 322 may comprise a first surface 328 offset the rear wall 316, a bottom surface 326 offset from the top surface 302, and a first side wall 327 and a second side wall 329. The first recess 320 and the second recess 322 may have the same size and shape. For instance, the first surfaces 324, 328 of each recess 320, 322 may be coplanar, and the bottom surfaces 321, 326 may be also be coplanar. Additionally, the width measured at the widest portion of each recess may be the same.

The bottom surface 321 of the first recess 320 and the bottom surface 236 of the second recess 322 may each have a securing structure 350, 352 respectively. The securing structures 350, 352 may comprise a threaded hole to receive a mechanical fastener.

As shown in FIGS. 4 and 10, the outer joining member 300 may have a plurality of engaging members positioned extending away from and beyond the front surface 313. These engaging members may engage features on the housing(s) 104 to inhibit rotation of the housing when it is connected to the outer joining member 300.

Each engaging member may have an engaging surface designed to communicate with a surface on the housing(s) 104. The plurality of engaging members are utilized for keyed and location alignment to ensure proper alignment and orientation of the outer joining member 300 and the housing(s) 104.

Additionally, the outer joining member 300 may also have a plurality of holes 366, 367, 368, 369 extending through the outer joining member 300. Securing members (not shown) may be inserted into the plurality of holes into corresponding securing structures (not shown) in the housing 104.

In addition, the outer joining member 300 may have a plurality of exterior surfaces 304, 306, 308 that have a smooth surface free of any features to provide the desired aesthetic appearance. Alternatively, the exterior surfaces 304, 306, 308 may have a textured or patterned surface finish.

Figure 12:
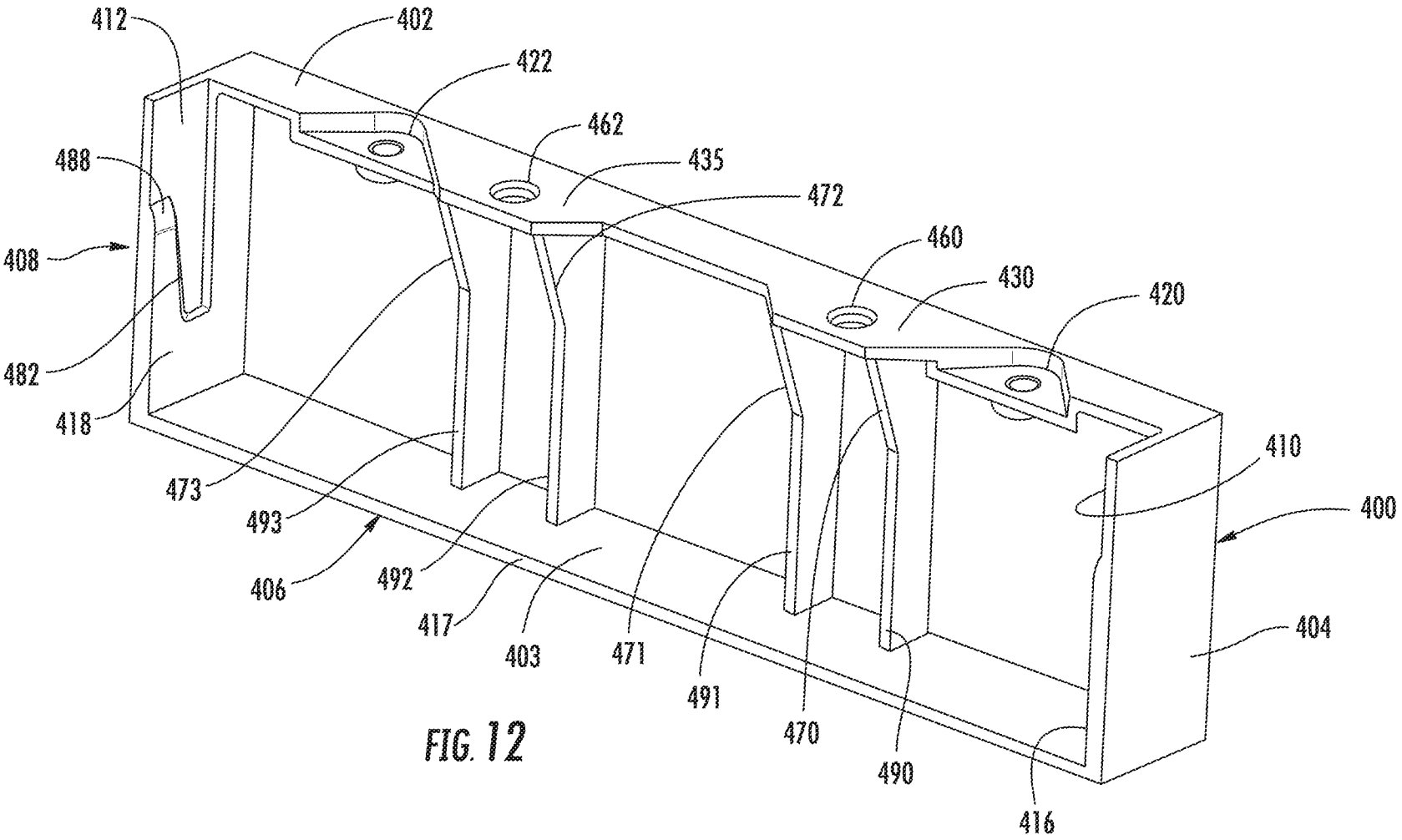
FIG. 12 illustrates a top front perspective view of an alternate embodiment of the component of FIG. 9.
Figure 13:
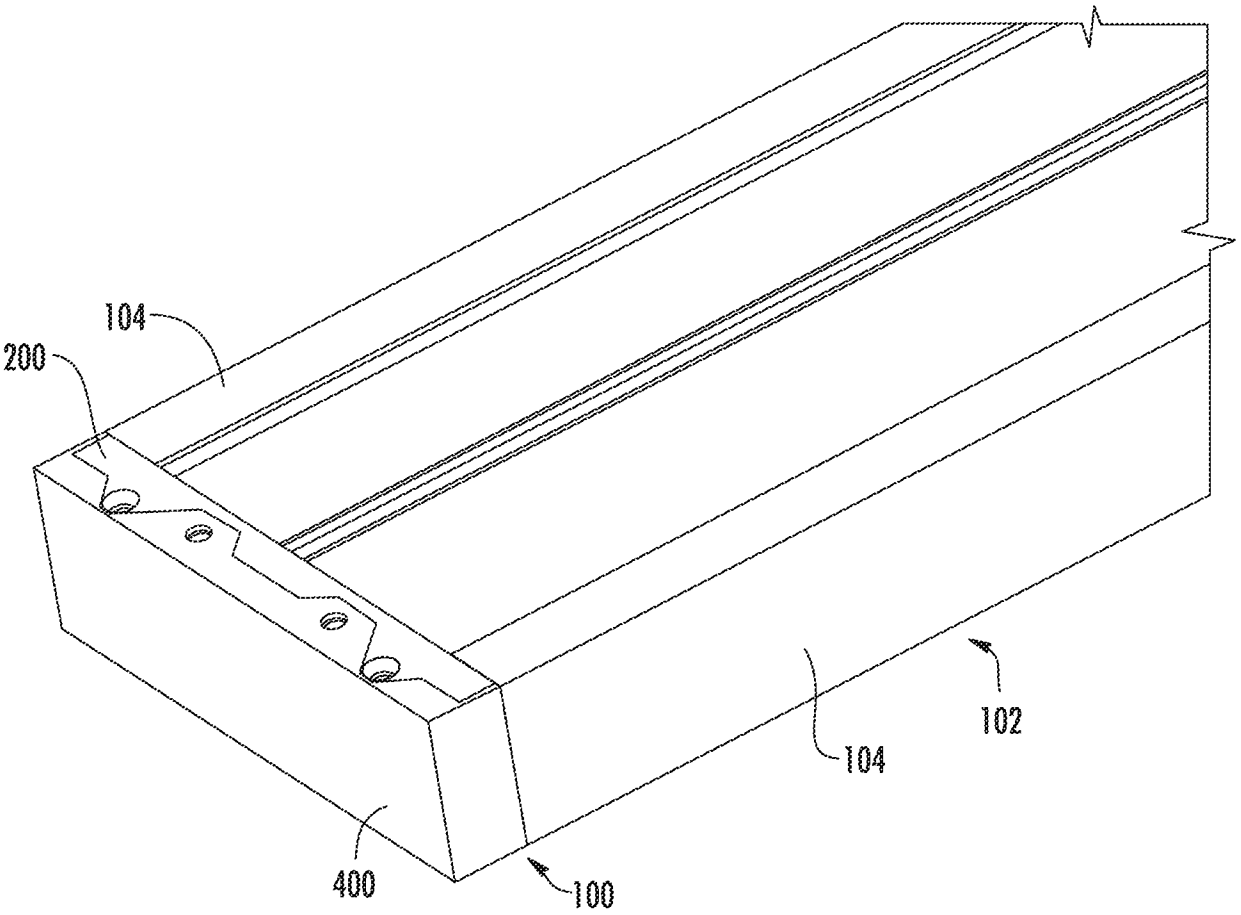
FIG. 13 illustrates a top rear perspective view of an example embodiment of a lighting fixture assembly using an alternate embodiment of the connection system according to one or more aspects described herein.
Figure 14:
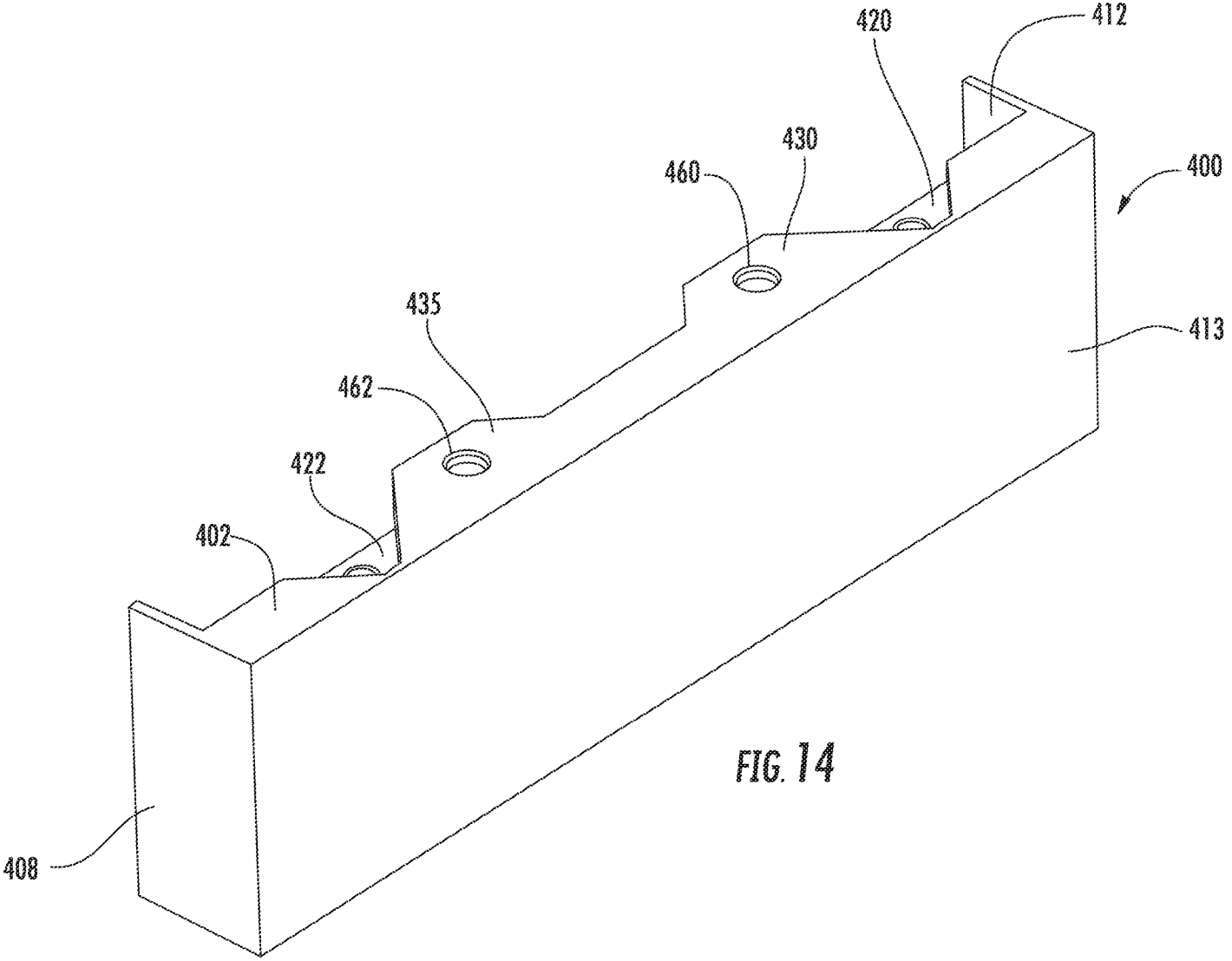
FIG. 14 illustrates a top rear perspective view of the component of FIG. 12.
Figure 15:
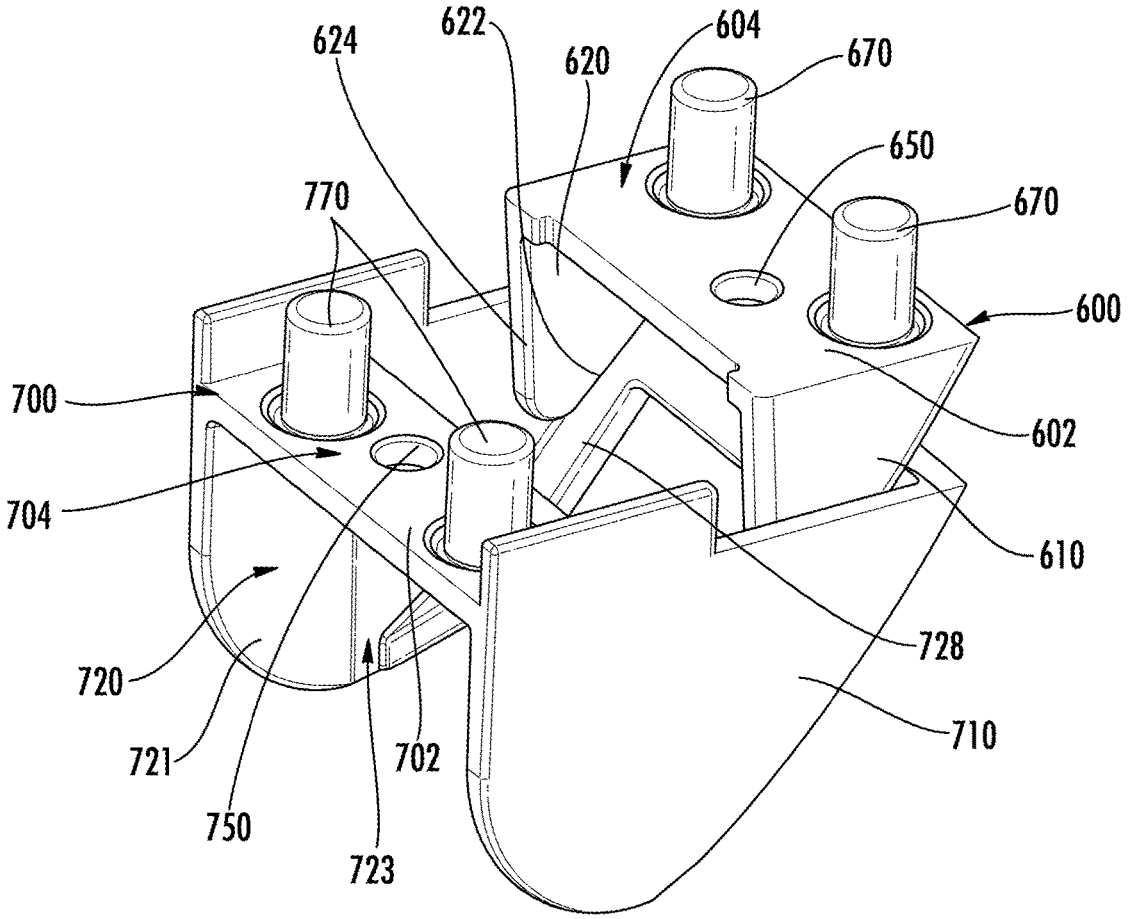
FIG. 15 illustrates a top side perspective view of another embodiment of a connection system for a lighting fixture according to one or more aspects described herein.

FIGS. 12-14 show an alternate embodiment of outer joining member 400. For the embodiment of FIGS. 12-14, the features are referred to using similar reference numerals under the "4XX" series of reference numerals, rather than "3XX" as used in the embodiment of FIGS. 1-11. Accordingly, certain features of the outer joining member 400 that were already described above with respect to outer joining member 300 of FIGS. 12-14 may be described in lesser detail, or may not be described at all. Outer joining member 400 may connect to the inner joining member 200 in the same manner as the outer joining member 300. Outer joining member 400 may be positioned on the light fixture 102 to create an end cap shown in FIG. 13. The outer joining member 400 may comprise a top surface 402, a front surface 413, a rear surface 417, a first side surface 404, a second side surface 408, a bottom surface 406, and a base surface 403 opposite the bottom surface 406, where each side surface 404, 408 has an interior surface 416, 418 with a recessed surface 410, 412 and a guide surface 480, 482. Additionally, the top surface 402 may comprise a plurality of flanges 430, 435 and a plurality of recesses 420, 422. The guide surface 480 may connect between the side surface 404 and the recessed surface 310. Likewise, guide surface 482 may connect between the side surface 408 and the recessed surface 412. In addition, a ramp surface 486 may be adjacent to the guide surface 480 and taper from the side surface 404 and the recess surface 410. Similarly, a ramp surface 488 may be adjacent to the guide surface 482 and taper from the side surface 408 and the recess surface 412.

Unlike outer joining member 300, the front surface 413 may be a smooth surface free of any features to provide the desired aesthetic appearance. Alternatively, the front surface 413 may have a textured or patterned surface finish.

As shown in FIG. 12, each flange 430, 435 may be supported by a plurality of gussets 470, 471, 472, 473 connected to an interior surface of the front surface 413 to the underside of the flanges. The gussets 470, 471, 472, 473 may connect to a plurality of ribs 490, 491, 492, 493 respectively extending along the interior surface to the base surface 403.

Materials

According to various aspects and embodiments, the inner joining member 200 and the outer joining member 300 may be formed of one or more of a variety of metallic materials (including metal alloys), such as, but not limited to, aluminum, aluminum alloys, steels (including stainless steels), titanium, and titanium alloys. The inner joining member 200 and the outer joining member 300 may also be formed of one or more of a variety of non-metallic materials, such as polymers, and composites (including fiber-reinforced composites) and may be formed in one of a variety of configurations, without departing from the scope of the invention. In one illustrative embodiment, both the inner joining member 200 and outer joining member 300 are made of metal. It is understood that the inner joining member 200 and outer joining member 300 may contain components made of several different materials, including fiber reinforced polymers, carbon-fiber composites, or other similar materials.

The inner joining member 200 and outer joining member 300 may be formed by various forming methods. For example, metal components, such as components made from titanium, aluminum, titanium alloys, aluminum alloys, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques. If either of the inner joining member 200 or outer joining member 300 is made of non-metallic materials, they may have a metallic coating to improve the strength and durability of the components.

FIGS. 15 through 19C illustrate another embodiment of a connection system for joining various light fixtures together. In commercial lighting, linear lighting fixtures are generally limited in the length in which they can be manufactured. Typically, a long continuous fixture is required, either for aesthetic or lighting performance. Thus, lighting manufacturers provide a means to join one segments of a fixture to the next, creating a "run". These joining methods range in approach, but as light fixtures increasingly shrink in housing size and lens aperture, space for joining mechanisms also become constricted. Joiners will generally need to hold the weight of a fixture during installation; align fixtures axially (straightness and twist control); and draw fixtures together creating a tight, clean seam. This all needs to be executed in a manner that is easy and repeatable as generally an installer can have up to hundreds of fixtures to join on a project. Existing joining solutions will typically require removal of internal components to gain access to the mechanisms, or compromise on the cosmetic of the resulting joint/seam (i.e., additional material, hardware, or gaps).

The disclosed embodiment illustrated in FIGS. 15 through 19C introduces a connection system that accommodates small aperture fixtures, while providing ample room for electrical connections and a cosmetically superior seam. As will be described in more detail below, the connection system consists of two mating brackets for the concealed joining of segments of light fixtures. The joiner design is completely integral to a fixture, with no externally visible hardware and no additional visual seams. This hollow design accommodates pass-through space for electrical wiring and connectors even in narrow aperture applications. Due to the sweeping nature of the joining action, internal fixture components do not need to be removed in order for correct joining to occur. Additionally this design requires that no components are removed from the fixture prior to joining, significantly reducing the time and effort that goes into joining fixtures in runs.

FIGS. 15 through 19C illustrate an example embodiment of a connection system 500 for joining various light fixtures 510, 520 together. The connection system 500 may include an inner mating bracket 600 nested within an outer mating bracket 700. The example embodiment of the connection system 500 creates a seamless joint 501 to connect a first light fixture 510 and a second light fixture 520 as shown in FIGS. 16A, 16B, 16C, 17, 19A, 19B, and 19C. FIG. 18A illustrates the inner mating bracket 600 of the connection system 500 and FIG. 18B illustrates the outer mating bracket 700 of the connection system 500.

Figure 18A:
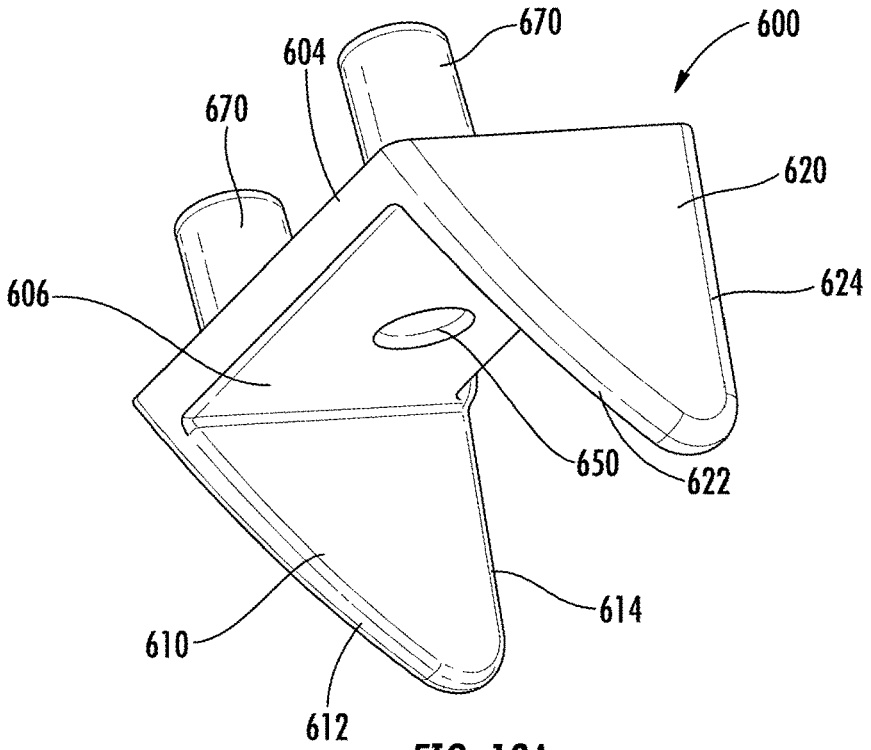
FIG. 18A illustrates a perspective view of an inner mating bracket of the connection system of FIG. 15 according to one or more aspects described herein.

The inner mating bracket 600 as shown individually in FIG. 18A may comprise a base 604 with a top surface 602 and a bottom surface 606. The inner matting bracket 600 may also include a first side wall 610 and a second side wall 620 opposite the first side wall 610. The first side wall 610 and the second side wall 620 may extend from the base 604 and the bottom surface 606. Each side wall 610, 620 may be triangular in shape extending from the base 604 with a curved ramp edge 612, 622 and a stopping edge 614, 624. The curved ramp edge 612, 622 may extend from the base 604 and meet the stopping edge 614, 624 thereby creating the triangular shape of each of the side walls 610, 620. Additionally, the stopping edge 614, 624 may extend from the base 604 in a perpendicular direction to the plane of the base 604 thereby creating a vertical edge for the stopping edge 614, 624.

Figure 17:
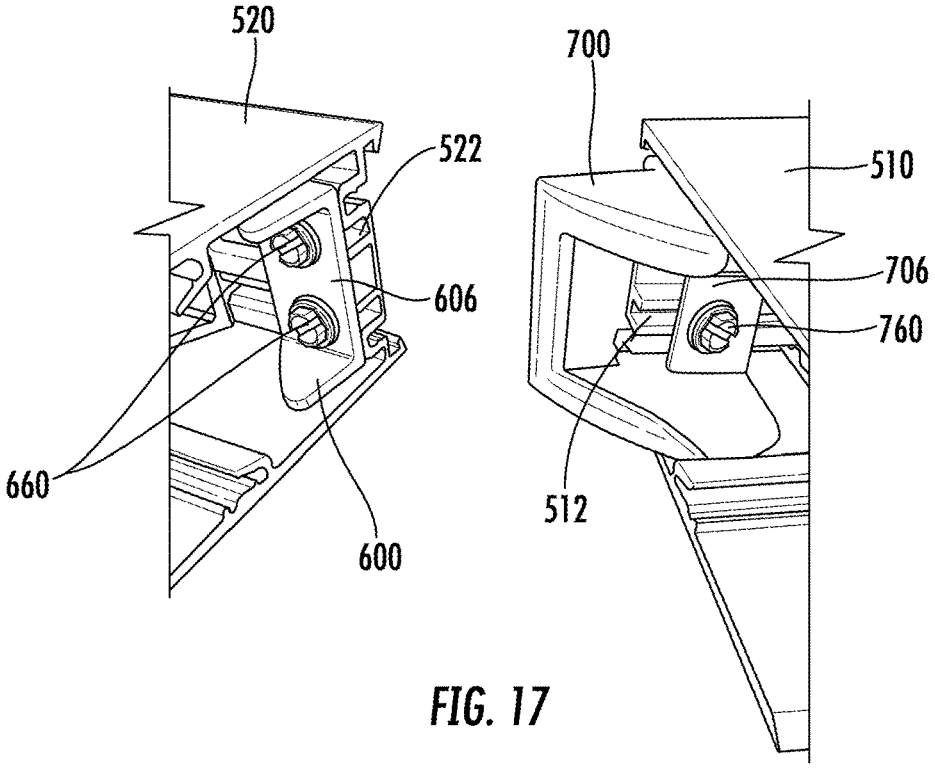
FIG. 17 illustrates a bottom perspective view of the embodiment of the lighting fixture and connection system of FIG. 16A.

The base 604 of the inner mating bracket 600 may also include one or more holes 650 to provide access to install one or more securing members 660 (as illustrated in FIG. 17) into a securing structure on an internal portion 522 of the end of the second light fixture 520. The securing member 660 may be a mechanical fastener installed through the hole 650 of the inner mating bracket 600. The at least one hole 650 may include a countersink or counterbore region on the bottom surface 606 of the base 604 to help a head of the fastener 660 to lie flush or substantially flush with the bottom surface 606.

The base 604 of the inner mating bracket 600 may also include one or more locating posts 670 to properly align the inner mating bracket 600 and inhibit rotation of the inner mating bracket 600 with respect to the second light fixture 520. As illustrated in FIG. 18A, the inner mating bracket 600 includes two locating posts 670. Other numbers of locating posts 670 may be utilized without departing from this invention. The one or more locating posts 670 may extend vertically and perpendicularly from the top surface 602 of the base 604 of the inner mating bracket 600. The one or more locating posts 670 may be cylindrical with a round cross-section, as illustrated in FIG. 18A. Other shapes of locating posts 670 may be utilized without departing from this invention. The one or more locating posts 670 may be utilized to guide and locate the inner mating bracket 600 into the internal portion 522 of the second light fixture 520. For example, the one or more locating posts 670 may fit or slide within guide rails on the internal portion 522 of the second light fixture 520.

Figure 16A:
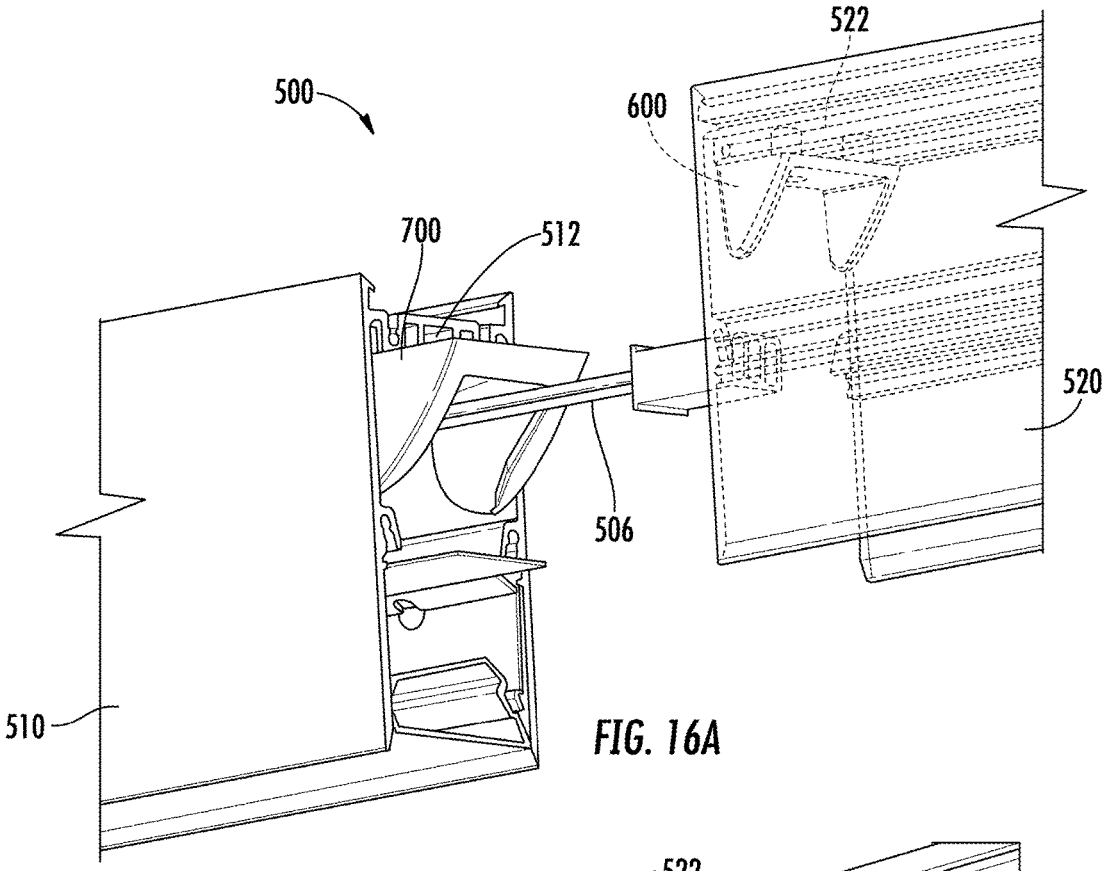
FIG. 16A illustrates a top side perspective view of another embodiment of a lighting fixture assembly using the alternate embodiment of the connection system of FIG. 15 according to one or more aspects described herein.
Figure 16B:
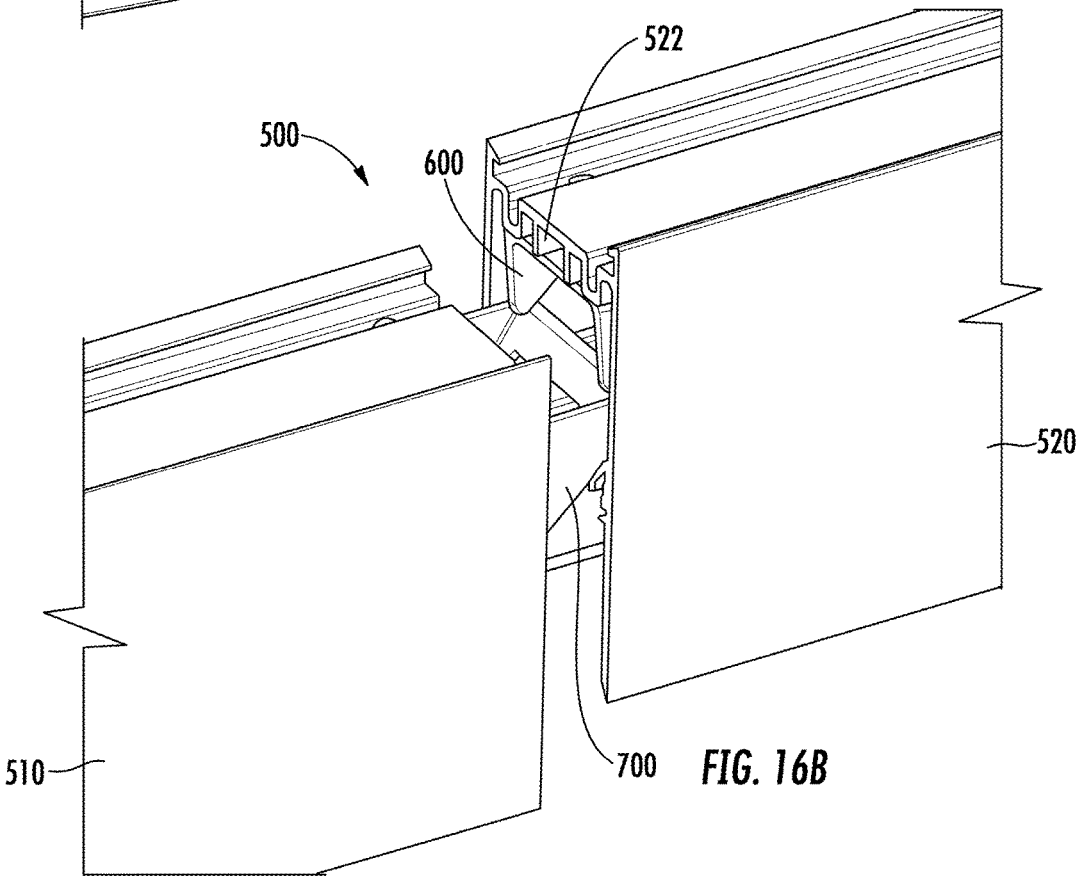
FIG. 16B illustrates a top side perspective view of the embodiment of the lighting fixture assembly and connection system of FIG. 16A with the connection system partially connecting two light fixtures.
Figure 18B:
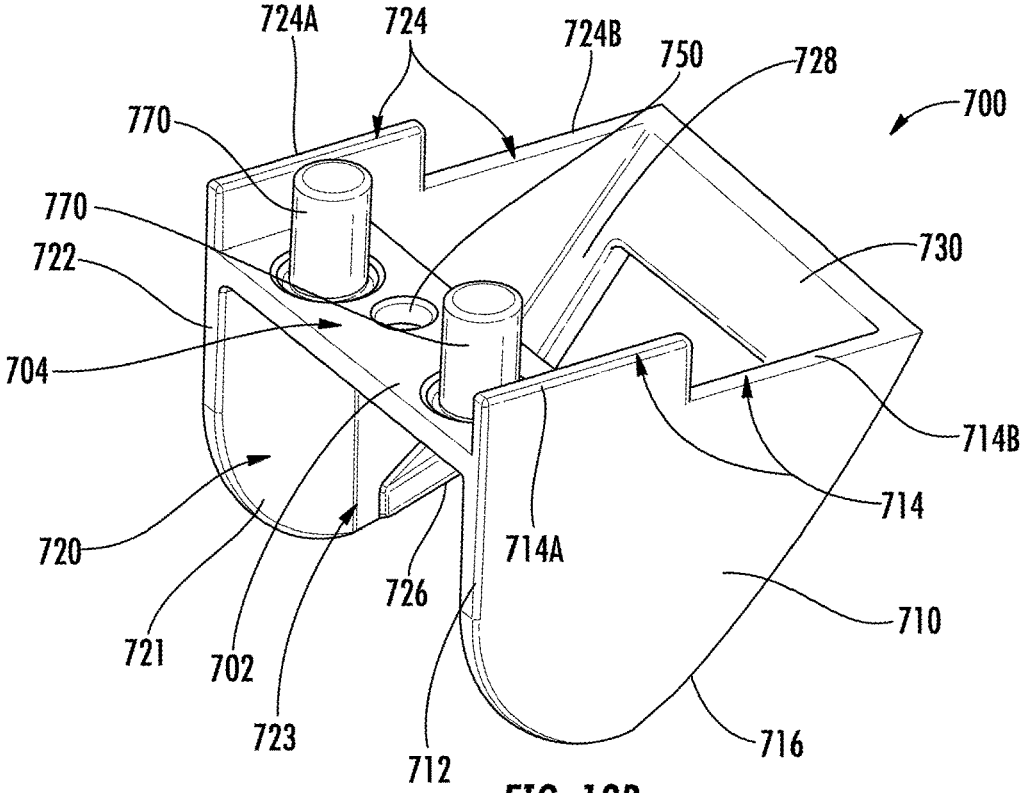
FIG. 18B illustrates a perspective view of an outer mating bracket of the connection system of FIG. 15 according to one or more aspects described herein.

The outer mating bracket 700 as shown individually in FIG. 18B may comprise a base 704 with a top surface 702 and a bottom surface 706. The outer matting bracket 700 may also include a first side wall 710 and a second side wall 720 opposite the first side wall 710. The first side wall 710 and the second side wall 720 may be adjacent to the base 704. The first side wall 710 and the second side wall 720 may be connected with a rear wall 730 opposite the base 704. As illustrated in FIGS. 16A and 18B, the base 704, the first side wall 710, the second side wall 720, and the rear wall 730 all create a hollow design for the outer mating bracket 700 that accommodates the inner mating bracket 600 and pass-through space for electrical wiring and connectors 506 even in narrow aperture applications.

The first side wall 710 and the second side wall 720 may include a vertical edge 712, 722, a horizontal edge 714, 724, and a curved edge 716, 726. The vertical edge 712, 722 may extend in a perpendicular direction to the base 704. The horizontal edge 714, 724 may extend from the vertical edge 712, 722 and the base 704 to the rear wall 730. The horizontal edge 714, 724 may also include a raised portion 714A, 724A and a lower portion 714B, 724B. The raised portion 714A, 724A may be located adjacent to the base 704 and the vertical edge 712, 722, while the lower portion 714B, 724B may be located adjacent to the rear wall 730. The lower portion 714B, 724B may be on the same plane as the rear wall 730, thereby creating a similar plane. The curved edge 716, 726 may curvedly extend from the vertical edge 712, 722 to the horizontal edge 714, 724. Other shapes of the first side wall 710 and the second side wall 720 may be utilized without departing from this invention.

The first side wall 710 and the second side wall 720 may also include a curved scoop ledge 718, 728 (718 not shown). The curved scoop ledge 718, 728 may extend from the rear wall 730 along an inner portion 711 (not shown) of the first side wall 710 and an inner portion 721 of the second side wall 720. The curved scoop ledge 718, 728 may extend along the curved edge 716, 726 and perpendicularly from the inner portion 711 of the first side wall 710 and the inner portion 721 of the second side wall 720. The size, shape, and width of the curved scoop ledge 718, 728 may match the curved ramp edge 612, 622 of the inner mating bracket 600. Additionally, the inner portion 711 of the first side wall 710 and the inner portion 721 of the second side wall 720 may include an internal stopping edge 713, 723 (713 not shown) that runs vertically along the inner portion 711, 721.

The base 704 of the outer mating bracket 700 may include one or more holes 750 to provide access to install one or more securing members 760 (as illustrated in FIG. 17) into a securing structure on an internal portion 512 of the end of the first light fixture 510. The securing member 760 may be a mechanical fastener installed through the hole 750 of the outer mating bracket 700. The at least one hole 750 may include a countersink or counterbore region on the bottom surface 706 of the base 704 of the outer mating bracket 700 to help a head of the fastener 760 to lie flush or substantially flush with the bottom surface 706.

The base 704 of the outer mating bracket 700 may also include one or more locating posts 770 to properly align the outer mating bracket 700 and inhibit rotation of the outer mating bracket 700 with respect to the first light fixture 510. As illustrated in FIG. 18B, the outer mating bracket 700 includes two locating posts 770. Other numbers of locating posts 770 may be utilized without departing from this invention. The one or more locating posts 770 may extend vertically and perpendicularly from the top surface 702 of the base 704 of the outer mating bracket 700. The one or more locating posts 770 may cylindrical with a round cross-section, as illustrated in FIG. 18B. Other shapes of locating posts 770 may be utilized without departing from this invention. The one or more locating posts 770 may be utilized to guide and locate the outer mating bracket 700 into the internal portion 512 of the first light fixture 510. For example, the one or more locating posts 770 may fit or slide within guide rails on the internal portion 512 of the first light fixture 510.

Figure 16C:
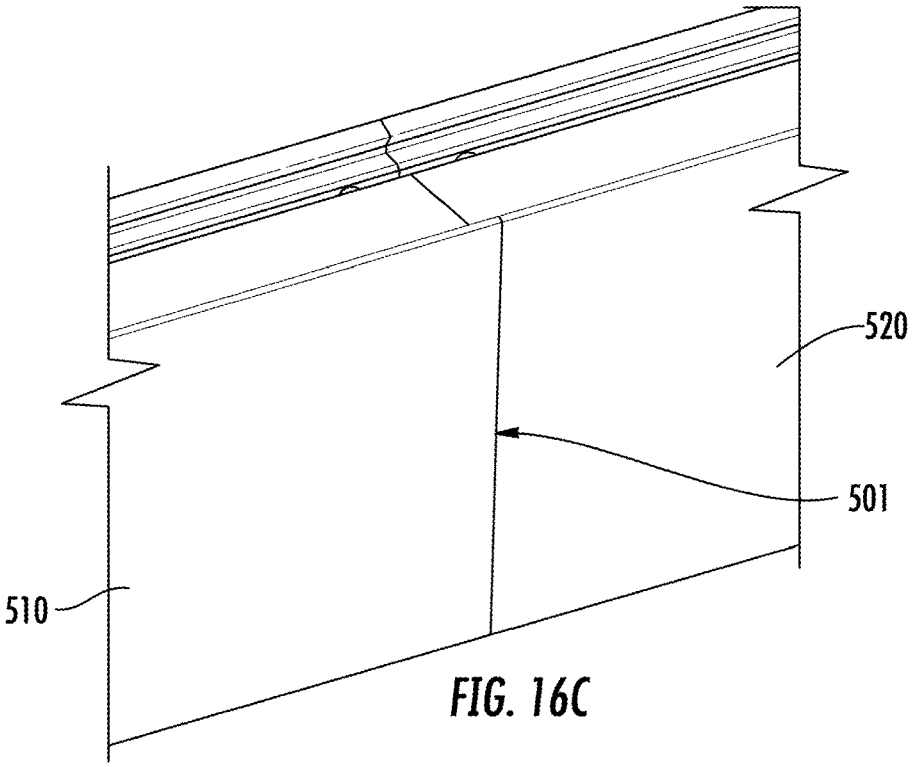
FIG. 16C illustrates a top side perspective view of the embodiment of the lighting fixture and connection system of FIG. 16A with the connection system completely connecting two light fixtures.
Figure 19A:
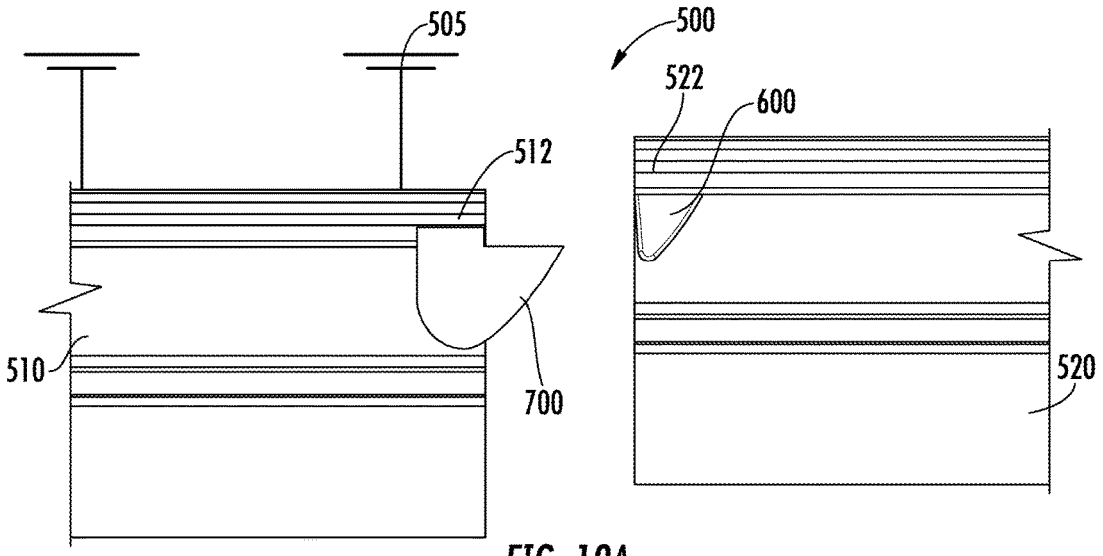
FIG. 19A illustrates a side view of the embodiment of the lighting fixture assembly and connection of FIGS. 15 and 16A.
Figure 19B:
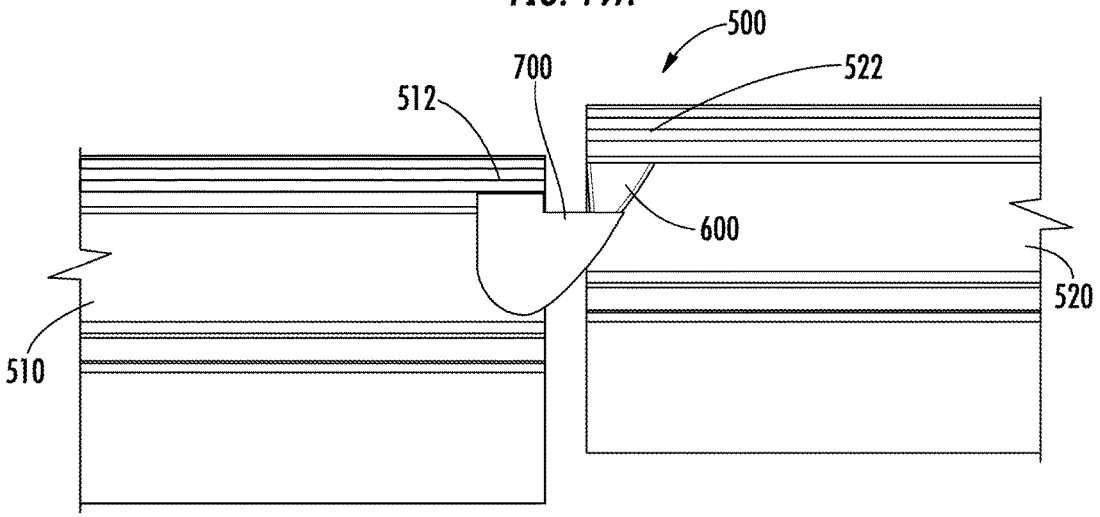
FIG. 19B illustrates a side view of the embodiment of the lighting fixture assembly and connection system of FIGS. 15 and 16B with the connection system partially connecting two light fixtures.
Figure 19C:
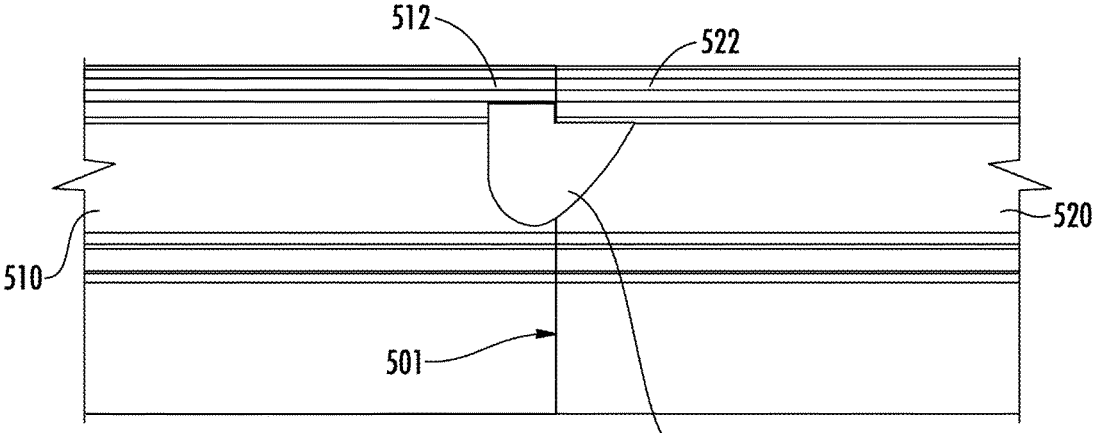
FIG. 19C illustrates a side view of the embodiment of the lighting fixture assembly and connection system of FIGS. 15 and 16C with the connection system completely connecting two light fixtures.

FIGS. 16A through 16C and 19A through 19C illustrate how the inner mating bracket 600 and the outer mating bracket 700 nest with each other. First, as illustrated in FIGS. 16A and 19A, the inner mating bracket 600 and outer mating bracket 700 may be mounted to opposite ends of separate light fixtures 510, 520. The outer mating bracket 700 may be secured to the first light fixture 510 using one or more locating posts 770 and the one or more securing members 760 through the one or more holes 750 of the outer mating bracket 700. The first light fixture 510 with the outer mating bracket 700 may be suspended from a building structure 505 first. The inner mating bracket 600 may be secured to the second light fixture 520 using the one or more locating posts 670 and the one or more securing members 660 through the one or more holes 650 of the inner mating bracket 600. Additionally, FIG. 16A illustrates the hollow design for the outer mating bracket 700 that accommodates pass-through space for electrical wiring and connectors 506 even in narrow aperture applications. As described above and further illustrated in FIG. 16B and 19B, the inner mating bracket 600 is then dropped into the outer mating bracket 700. Gravity assisted, the inner mating bracket 600 slides within the outer mating bracket 700 and nests in a controlled sweep due to the curved ramp 612, 622 on the inner mating bracket 600 coupling with the curved scoop ledge 716, 726 on the outer mating bracket 700. The inner mating bracket 600 stops within the outer mating bracket 700 because of the mating of the stopping edge 614, 624 of the inner mating bracket 600 and the internal stopping edge 713, 723 of the outer mating bracket 700. Additionally, the second light fixture 520 with the inner mating bracket 600 may seat on the similar plane created by the wall 730 and the lower portion 714B, 724B of the horizontal edge 714, 724 on the outer mating bracket 700. Since the inner mating bracket 600 and the outer mating bracket 700 both remain inboard their respective light fixtures 510, 520, the seam 501 created by joining the two fixtures 510, 520 is created merely by the housings mating, as illustrated in FIGS. 16C and 19C. No additional hardware or material is visible at the seam or joint 501.

Typically, a long continuous fixture is required, either for aesthetic or lighting performance. The inner mating bracket 600 and outer mating bracket 700 may be utilized as illustrated in FIGS. 15 through 19C and described above by lighting manufacturers to provide a means to join segments of light fixtures to the next light fixture, thereby creating a "run" of light fixtures.

Figure 20A:
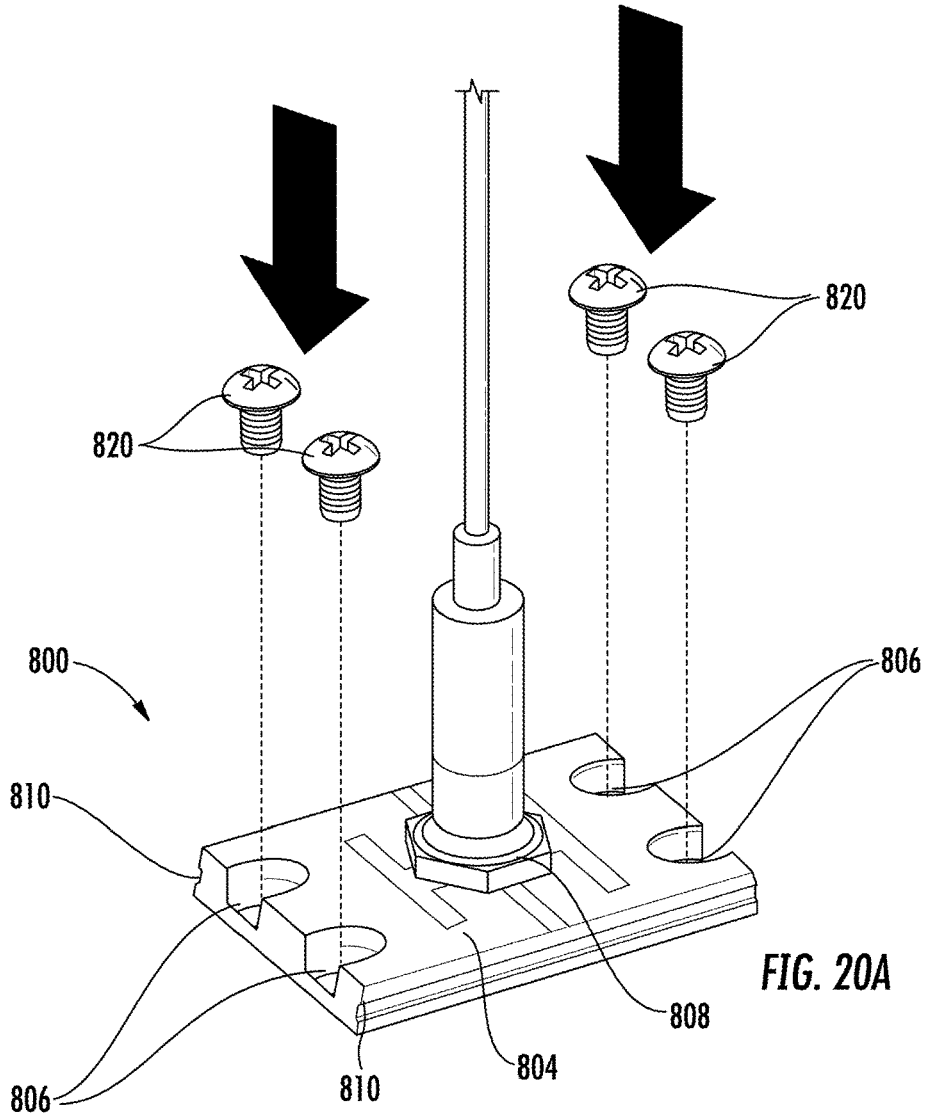
FIG. 20A illustrates a side perspective view of a center joining plate for use with the connection system of FIG. 15.
Figure 20B:
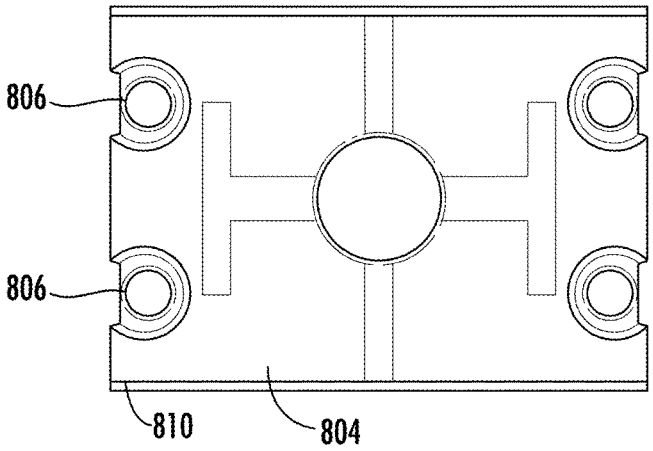
FIG. 20B illustrates a top perspective view of the center joining plate of FIG. 20A for use with the connection system of FIGS. 15.

Additionally, a center joining plate 800 may be utilized in accordance with aspects of this invention. FIGS. 20A, 20B, and 21A-21D illustrate the center joining plate 800 that acts a sliding bracket/plate on the top of the light fixtures 510, 520 and helps to secure the light fixtures 510, 520 together. As illustrated in FIGS. 20A and 20B, the center joining plate 800 may include a base 804. The base 804 of the center joining plate 800 may include a cable gripper 808 attached to the base 804. The cable gripper 808 may connect a cable 530 suspended from the ceiling to the light fixtures 510, 520. The center joining plate 800 may also include one or more sliding edges 810 located on opposite sides of the base 804. The sliding edges 810 may be configured to slide under a lip or sliding structure 516, 526 on the light fixtures 510, 520. The engagement and cooperation between the sliding edges 810 of the center joining plate 800 and the sliding structure 516, 526 of the light fixtures 510, 520 secures the center joining plate 800 to the light fixtures 510, 520 while also allowing the center joining plate 800 to slide between the first light fixture 510 and the second light fixture 520.

The center joining plate 800 and the base 804 may include one or more holes 806 to provide access to install one or more securing members 820 into a securing structure on an external portion 514, 524 of the end of the light fixtures 510, 520. The securing member 820 may be a mechanical fastener installed through the hole 806 of the center joining plate 800. The one or more holes 806 may include a countersink or counterbore region on the base 804 of the center joining plate 800 to help a head of the fastener 820 to lie flush or substantially flush with the base 804.

Figure 21A:
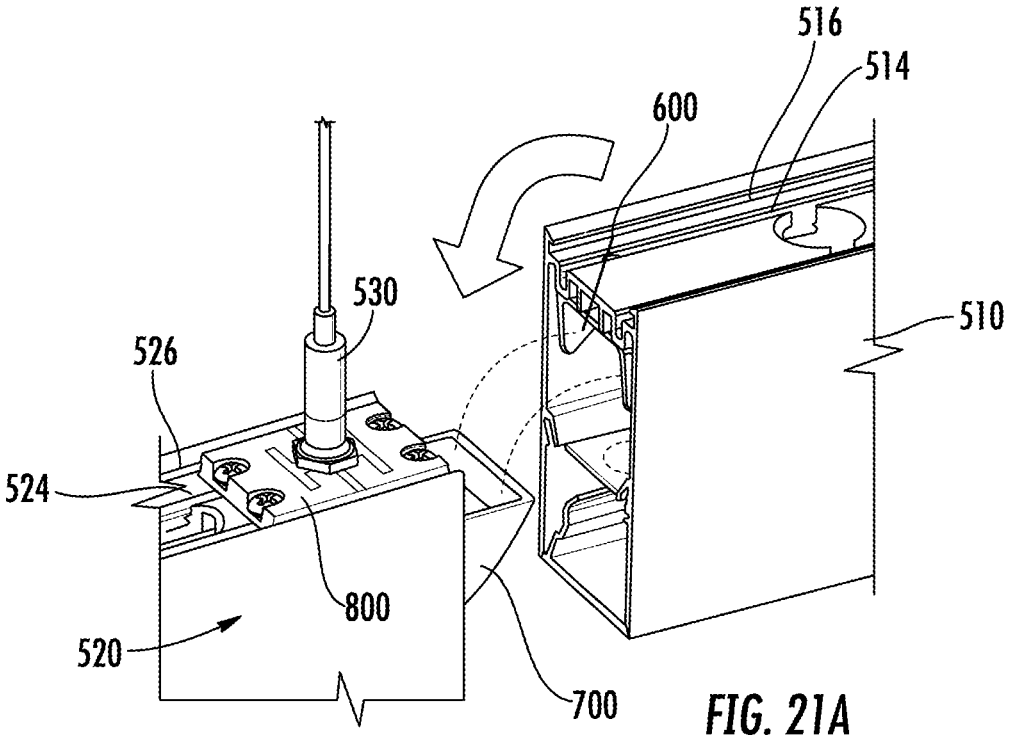
FIGS. 21A-21D illustrate views of the center joining plate of FIG. 20A used in operation with the connection system of FIG. 15.
Figure 21B:
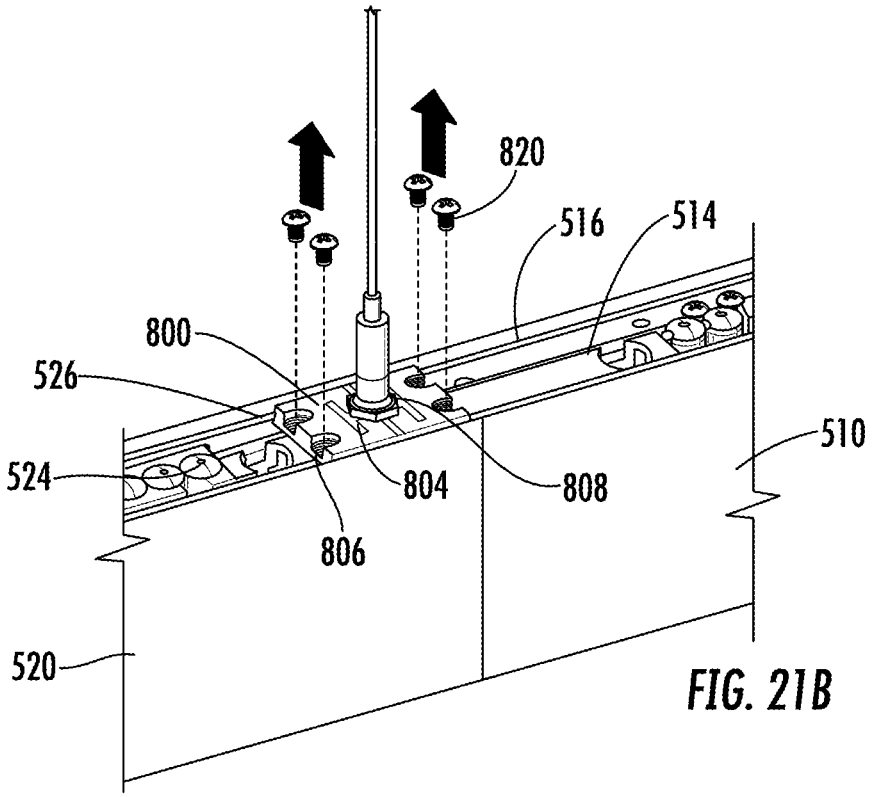
Figure 21C:
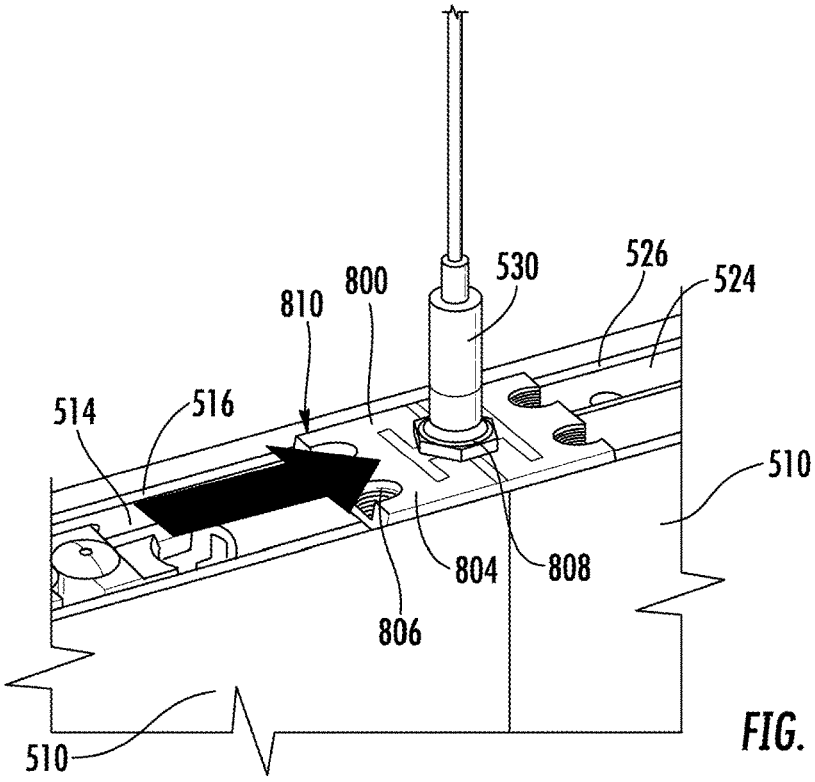
Figure 21D:
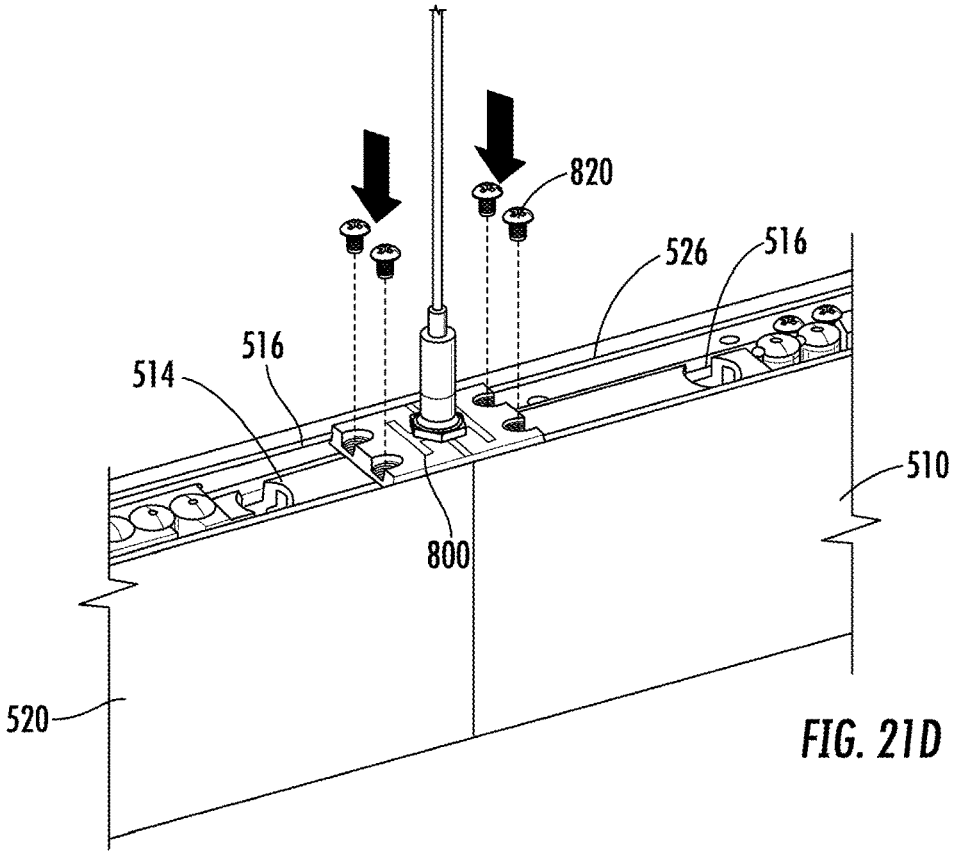

FIGS. 21A-21D illustrate the operation and installation of the center joining plate 800 on the first light fixture 510 and the second light fixture 520. FIG. 21A illustrates the inner mating bracket 600 sliding into the outer mating bracket 700 and the center joining plate 800 secured to the second light fixture 520. The cable gripper 808 is connected to the cable 530 suspended from the ceiling and the securing members 820 are installed through the holes 806 of the center joining plate 800, thus securing the center joining plate 800 to the second light fixture 520. FIG. 21B illustrates the inner mating bracket 600 and the outer matting bracket 700 fully engaged with each other thereby creating the seamless joint 501. As further illustrated in FIG. 21B, the securing members 820 may be removed from the holes 806 so that the center joining plate 800 can slide freely to a location between the first light fixture 510 and the second light fixture 520. FIG. 21C illustrates the sliding action of the center joining plate 800 from the second light fixture 520 towards the first light fixture 510, thereby further connecting the first light fixture 510 and the second light fixture 520. FIG. 21D illustrates the center joining plate 800 secured to both the first light fixture 510 and the second light fixture 520. The securing members 820 may be installed and secured through the holes 806 of the center joining plate 800 to both the first light fixture 510 and the second light fixture 520, thus securing the center joining plate 800 to the first light fixture 510 and the second light fixture 520.

According to various aspects and embodiments, the inner mating bracket 600, the outer mating bracket 700, and the center joining plate 800 may be formed of one or more of a variety of metallic materials (including metal alloys), such as, but not limited to, aluminum, aluminum alloys, steels (including stainless steels), titanium, and titanium alloys. The inner mating bracket 600, the outer mating bracket 700, and the center joining plate 800 may also be formed of one or more of a variety of non-metallic materials, such as polymers, and composites (including fiber-reinforced composites) and may be formed in one of a variety of configurations, without departing from the scope of the invention. In one illustrative embodiment, the inner mating bracket 600, the outer mating bracket 700, and the center joining plate 800 are made of metal. It is understood that the inner mating bracket 600, the outer mating bracket 700, and the center joining plate 800 may contain components made of several different materials, including fiber reinforced polymers, carbon-fiber composites, or other similar materials.

The inner mating bracket 600, the outer mating bracket 700, and the center joining plate 800 may be formed by various forming methods. For example, metal components, such as components made from titanium, aluminum, titanium alloys, aluminum alloys, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques. If the inner mating bracket 600, the outer mating bracket 700, and the center joining plate 800 is made of non-metallic materials, they may have a metallic coating to improve the strength and durability of the components.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A connection system for a luminaire, comprising:

an outer mating bracket configured to attach to a first light fixture, the outer mating bracket comprising a base, a first side wall, a second side wall, and a rear wall, wherein the first side wall and the second side wall are adjacent to the base and are connected with the rear wall opposite the base, wherein each side wall of the outer mating bracket includes a curved scoop ledge that extends from the rear wall along an inner portion of the first side wall and an inner portion of the second side wall, wherein the base of the outer mating bracket includes one or more holes to provide access to install one or more securing members into a securing structure on an internal portion of the first light fixture, and further wherein the outer mating bracket includes one or more locating posts to align the outer mating bracket and inhibit rotation of the outer mating bracket with respect to the first light fixture; and an inner mating bracket configured to attach to a second light fixture, the inner mating bracket comprising a base, a first side wall, and a second side wall opposite the first wall, wherein the first side wall and the second side wall extend from the base, with each side wall having a curved ramp edge and a stopping edge, wherein the base of the inner mating bracket includes one or more holes to provide access to install one or more securing members into a securing structure on an internal portion of the second light fixture, and further wherein the inner mating bracket includes one or more locating posts to align the inner mating bracket and inhibit rotation of the inner mating bracket with respect to the second light fixture;

wherein, gravity assisted, the inner mating bracket slides and nests within the outer mating bracket with the curved ramp edge of the inner mating bracket coupling with the curved scoop ledge on the outer mating bracket, thereby connecting the first light fixture to the second light fixture and creating a concealed and seamless connection between the inner mating bracket of the first light fixture and the outer mating bracket of the second light fixture.

2. A connection system for a luminaire of claim 1, wherein the first side wall and the second side wall of the inner mating bracket is triangular in shape and extending from the base.

3. A connection system for a luminaire of claim 2, wherein the stopping edge extends perpendicular from the base and the curved ramp edge extends from the base and meets the stopping edge thereby creating the triangular shape of each of the side walls of the inner mating bracket.

4. A connection system for a luminaire of claim 1, wherein the one or more holes on the base of the inner mating bracket and the one or more holes on the outer mating bracket includes a countersink region.

5. A connection system for a luminaire of claim 1, wherein the one or more holes on the base of the inner mating bracket and the one or more holes on the outer mating bracket includes a counterbore region.

6. A connection system for a luminaire of claim 1, wherein the one or more locating posts on the inner mating bracket and the outer mating bracket extend vertically and perpendicularly from the base of the inner mating bracket and the outer mating bracket, and further wherein the one or more posts are cylindrical with a round cross-section.

7. A connection system for a luminaire of claim 1, wherein the first side wall, the second side wall, and the rear wall of the outer mating bracket create a hollow structure for the outer mating bracket to create a pass-through space for electrical wiring and connectors.

8. A luminaire, comprising:

a first light fixture with an outer mating bracket attached to the first light fixture, the outer mating bracket comprising a base, a first side wall, a second side wall, and a rear wall, wherein the first side wall and the second side wall are adjacent to the base and are connected with the rear wall opposite the base, wherein each side wall of the outer mating bracket includes a curved scoop ledge that extends from the rear wall along an inner portion of the first side wall and an inner portion of the second side wall, wherein the outer mating bracket is secured to the first light fixture with one or more securing members through the base of the outer mating bracket to an internal portion of the first light fixture, and further wherein the outer mating bracket includes one or more locating posts to align the outer mating bracket and inhibit rotation of the outer mating bracket with respect to the first light fixture;

a second light fixture with an inner mating bracket attached to the second light fixture, the inner mating bracket comprising a base, a first side wall, and a second side wall opposite the first wall, wherein the first side wall and the second side wall extend from the base, with each side wall having a curved ramp edge and a stopping edge, wherein the inner mating bracket is secured to the second light fixture with one or more securing members through the base of the inner mating bracket to an internal portion of the second light fixture, and further wherein the inner mating bracket includes one or more locating posts to align the inner mating bracket and inhibit rotation of the inner mating bracket with respect to the second light fixture; and a center joining plate that slides between the first light fixture and the second light fixture to secure the first and second light fixtures together;

wherein, gravity assisted, the inner mating bracket slides and nests within the outer mating bracket with the curved ramp edge of the inner mating bracket coupling with the curved scoop ledge on the outer mating bracket thereby connecting the first light fixture to the second light fixture and creating a concealed and seamless connection between the first light fixture and the second light fixture.

9. A luminaire of claim 8, wherein the first side wall and the second side wall of the inner mating bracket is triangular in shape and extending from the base.

10. A luminaire of claim 9, wherein the stopping edge extends perpendicular from the base and the curved ramp edge extends from the base and meets the stopping edge thereby creating the triangular shape of each of the side walls of the inner mating bracket.

11. A luminaire of claim 8, wherein the one or more locating posts on the inner mating bracket and the outer mating bracket extend vertically and perpendicularly from the base of the inner mating bracket and the outer mating bracket, and further wherein the one or more posts are cylindrical with a round cross-section.

12. A luminaire of claim 8, wherein the first side wall, the second side wall, and the rear wall of the outer mating bracket create a hollow structure for the outer mating bracket to create a pass-through space for electrical wiring and connectors.

13. A luminaire of claim 8, further wherein the center joining plate is slidably engaged with a top portion of the first light fixture and a top portion of the second light fixture.

14. A luminaire of claim 13, wherein the center joining plate includes a cable gripper that connects to a cable suspended from the ceiling and the first and second light fixtures.

15. A luminaire of claim 13, wherein the center joining plate include a sliding edge on opposite sides of the center joining plate, wherein the sliding edges are configured to slide under a sliding structure on the first and second light fixtures.

16. A luminaire of claim 13, wherein the center joining plate includes one or more holes to provide access to install one or more securing members into a securing structure on an external portion of the first light fixture and the second light fixture.

17. A connection system for a luminaire, comprising:

an outer mating bracket configured to attach to a first light fixture, the outer mating bracket comprising a base, a first side wall, a second side wall, and a rear wall, wherein the first side wall and the second side wall are adjacent to the base and are connected with the rear wall opposite the base, wherein each side wall of the outer mating bracket includes a curved scoop ledge that extends from the rear wall along an inner portion of the first side wall and an inner portion of the second side wall; and an inner mating bracket configured to attach to a second light fixture, the inner mating bracket comprising a base, a first side wall, and a second side wall opposite the first wall, wherein the first side wall and the second side wall extend from the base, with each side wall having a curved ramp edge and a stopping edge;

wherein, gravity assisted, the inner mating bracket slides and nests within the outer mating bracket with the curved ramp edge of the inner mating bracket coupling with the curved scoop ledge on the outer mating bracket thereby connecting the first light fixture to the second light fixture and creating a concealed and seamless connection between the inner mating bracket of the first light fixture and the outer mating bracket of the second light fixture.

18. A connection system for a luminaire of claim 17, wherein the first side wall and the second side wall of the inner mating bracket is triangular in shape and extending from the base, and further wherein the stopping edge extends perpendicular from the base and the curved ramp edge extends from the base and meets the stopping edge thereby creating the triangular shape of each of the side walls of the inner mating bracket.

19. A connection system for a luminaire of claim 17, wherein the outer mating bracket includes one or more locating posts to align the outer mating bracket and inhibit rotation of the outer mating bracket with respect to the first light fixture, and wherein the one or more locating posts on the outer mating bracket extend vertically and perpendicularly from the base of the outer mating bracket.

20. A connection system for a luminaire of claim 17, wherein the inner mating bracket includes one or more locating posts to align the inner mating bracket and inhibit rotation of the inner mating bracket with respect to the second light fixture, and wherein the one or more locating posts on the inner mating bracket extend vertically and perpendicularly from the base of the inner mating bracket.

* * * * *